US005262288A

United States Patent [19]

Sakanoue et al.

[11] Patent Number: 5,262,288

[45] Date of Patent: Nov. 16, 1993

[54] SILVER HALIDE COLOR PHOTOGRAPHIC PHOTOSENSITIVE MATERIAL CONTAINING PYRAZOLONE AND PYRAZOLOAZOLE MAGENTA COUPLERS

[75] Inventors: Kei Sakanoue; Yuki Mizukawa, both of Kanagawa, Japan

[73] Assignee: Fuji Photo Film Co., Ltd., Kanagawa, Japan

[21] Appl. No.: 731,230

[22] Filed: Jul. 17, 1991

[30] Foreign Application Priority Data

Jul. 18, 1990 [JP] Japan ..... 2-190311

[51] Int. Cl.[5] ..... G03C 7/38; G03C 7/384

[52] U.S. Cl. ..... 430/506; 430/554; 430/558; 430/549

[58] Field of Search ..... 430/558, 554, 555, 549, 430/506

[56] References Cited

U.S. PATENT DOCUMENTS

| | | | |
|---|---|---|---|
| 3,725,067 | 4/1973 | Bailey et al. | 430/558 |
| 4,600,688 | 7/1986 | Kawakatsu et al. | 430/558 |
| 4,621,046 | 11/1986 | Sato et al. | 430/381 |
| 4,622,287 | 11/1986 | Umemoto et al. | 430/505 |
| 4,746,599 | 5/1988 | Deguchi et al. | 430/504 |
| 4,994,351 | 2/1991 | Haga et al. | 430/379 |

FOREIGN PATENT DOCUMENTS

| | | | |
|---|---|---|---|
| 0152296 | 8/1985 | European Pat. Off. | 430/549 |
| 2336711 | 7/1977 | France . | |
| 2194254 | 8/1987 | Japan | 430/549 |
| 1488855 | 10/1977 | United Kingdom . | |
| 1552701 | 9/1979 | United Kingdom . | |

*Primary Examiner*—Lee C. Wright
*Attorney, Agent, or Firm*—Sughrue, Mion, Zinn, Macpeak & Seas

[57] ABSTRACT

A silver halide color photographic photosensitive material comprises a support, having thereon at least one silver halide emulsion layer, wherein a coupler represented by formula (I) shown below is included in at least one layer of the photosensitive material, and a coupler represented by formula (M) shown below is included in at least one layer of the photosensitive material:

(I)

wherein $R_1$ represents an aryl group having substituents the sum of whose Hammett's rule substituent $\sigma$ constants is at least 0.2, and $R_2$ represents an aryl group having substituents the sum of whose Hammett's rule substituent $\sigma$ constants is at least 0.75;

(M)

wherein $R_1$ represents a hydrogen atom or a substituent group; Z represents a group of nonmetal atoms which is required to form either (1) a five-membered azole ring which has two or three nitrogen atoms, and which may have substituent groups (including condensed rings), or (2) an unsubstituted five-membered azole ring which has four nitrogen atoms; and X represents a hydrogen atom or a group which can be eliminated at the time of a coupling reaction with an oxidation product of a developing agent.

7 Claims, No Drawings

SILVER HALIDE COLOR PHOTOGRAPHIC PHOTOSENSITIVE MATERIAL CONTAINING PYRAZOLONE AND PYRAZOLOAZOLE MAGENTA COUPLERS

FIELD OF THE INVENTION

This invention concerns silver halide color photographic photosensitive materials.

BACKGROUND OF THE INVENTION

In recent years the manufacturers of color photographic photosensitive materials have made progress in increasing the photographic speed of photosensitive materials and increasing picture quality in response to the needs of the user. In this connection, increased image quality has involved the improvement of graininess, the improvement of sharpness and the improvement of color reproduction. These factors are very important in determining the performance of a photosensitive material, and it is clear that improvements in these factors will have to continue in the future.

In connection with color reproduction from among these factors, attention has been focused in recent years on improving the hue of the magenta color by using pyrazoloazole based magenta couplers in place of the 5-pyrazolone type couplers which had been used in the past.

The dyes which are formed by the reaction between these couplers and oxidation products of color developing agents have little of the harmful side absorbance which affects color reproduction and so the color reproduction range can be widened. These couplers have been disclosed, for example, in U.S. Pat. Nos. 3,725,067 and 4,621,046 and other publications. (The term "JP-A" as used herein signifies an "unexamined published Japanese patent application".)

On the other hand, the inclusion of formaldehyde in the final bath in the development processing of camera color materials (color negative and color reversal materials) is well known for improving the fastness of the magenta image.

Much research has already been done in connection with the role of formaldehyde and, for example, the fact that a pyrazolone coupler reacts with azomethine dyes and provokes fading of the dyes has been disclosed by P. W. Vittum and F. C. Duennebier in *J. Am. Chem. Soc.*, 72, 1536 (1950). On the other hand, the addition of formaldehyde to a stabilizing bath to prevent unreacted couplers from reacting with dyes, which in turn prevents fading, has been disclosed by R. W. G. Hunt in *The Reproduction of Color*, second edition, J. Wiley and Sons, Inc., New York, p.306 (1967). Furthermore, similar disclosures have also been made in *The Journal of Photographic Science*, 36, 64 (1988). Formaldehyde thus plays a major part in the fastness of the image, but it causes problems in connection with environmental protection and there is a strong demand for its removal from photographic processing liquids.

As an example, it is disclosed in JP-A-60-98435 that these is no loss of colored image fastness when a two-equivalent pyrazolone coupler is used even when essentially no formaldehyde is included. Moreover, it is disclosed in JP-A-62-54261 that there is no loss of colored image fastness even when the formaldehyde is omitted from the stabilizing bath when a two-equivalent type pyrazoloazole type coupler is used. However, in the former case there is no improvement in color reproduction, and in the latter case the worsening of graininess is a serious problem.

Moreover, the fact that no formaldehyde is included in the Ektaprint 3 chemicals which are the processing baths for the new magenta couplers introduced by the Kodak Co. in Ektacolor 30RC has been disclosed in *J. Imag. Tech.*, 11, 93 (1985). The magenta couplers used here are the four-equivalent anilino type magenta couplers which have so-called anilino substituent groups as disclosed, for example, in U.S. Pat. No. 3,127,269.

It is possible to omit the formaldehyde from the stabilizing bath when these couplers are used. However, there is inadequate improvement in color reproduction when the above mentioned couplers are used in camera materials and there is a particular and serious problem in that reds are reproduced as scarlet colors.

These four-equivalent anilino type magenta couplers give rise to problems with color reproduction when used as they are, being at a shorter wavelength than the magenta couplers which have acylamino groups as substituent groups which have been used conventionally in camera materials, and the reproduction of reds is adversely affected. Moreover, saturation is greatly improved when two-equivalent pyrazoloazole types are used, but this has the disadvantage of greatly worsening the graininess.

Moreover, when processed in a color developer of pH 11 or above there is a pronounced increase in color mixing between layers and this is very noticeable when two-equivalent pyrazoloazole types are used in camera color reversal photographic photosensitive materials.

SUMMARY OF THE INVENTION

Hence, a first object of the present invention is to provide color photographic photosensitive materials with which color reproduction is improved and with which there is no worsening of graininess.

A second object of the invention is to provide color photosensitive materials with which there is no worsening of image fastness even if formaldehyde is omitted from the photographic processing liquids.

A third object of the invention is to prevent any increase in color mixing between layers when a pyrazolotriazole based magenta coupler is used in a camera color reversal photosensitive material and the pH of the color developer is high.

As a result of thorough research, the present inventors have discovered that the objects of the present invention can be realized in a silver halide color photographic photosensitive material comprising a support, having thereon at least one silver halide emulsion layer, wherein a coupler which can be represented by formula (I) indicated below is included in at least one layer of the photosensitive material, and a coupler which can be represented by formula (M) indicated below is included in at least one layer of the photosensitive material:

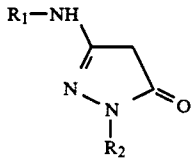

(I)

Wherein $R_1$ represents an aryl group having substituents the sum of whose Hammett's rule substituent $\sigma$ constants is at least about 0.2, and $R_2$ represents an aryl group having substituents the sum of whose Hammett's rule substituent $\sigma$ constants is at least about 0.75;

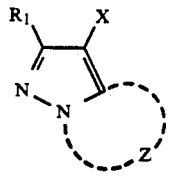

(M)

Wherein $R_1$ represents a hydrogen atom or a substituent group; Z represents a group of nonmetal atoms which is required to form either (1) a five-membered azole ring which has two or three nitrogen atoms, and which may have substituent groups (including condensed rings), or (2) an unsubstituted five-membered azole ring which has four nitrogen atoms; and X represents a hydrogen atom or a group which can be eliminated at the time of a coupling reaction with an oxidation product of a developing agent.

In a preferred embodiment of the invention, the silver halide color photographic photosensitive material comprises a support, having thereon a green sensitive emulsion layer consisting of at least two layers as disclosed above wherein at least one coupler represented by formula (I) is included in the higher speed layer and at least one coupler represented by formula (M) is included in the lower speed layer.

In another aspect of the present invention, there is provided a method of processing the silver halide color photographic photosensitive material of the invention which comprises processing the material in a developer which has a pH of at least about 11.

DETAILED DESCRIPTION OF THE INVENTION

Formula (I) is described in detail below:

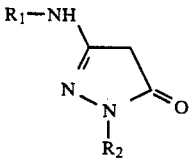

(I)

In formula (I), $R_1$ represents an aryl group having substituents the sum of whose Hammett's rule substituent $\sigma$ constants is at least about 0.2, and $R_2$ represents an aryl group having substituents the sum of whose Hammett's rule substituent $\sigma$ constants is at least about 0.75.

The substituent groups in formula (I) are described in detail below, but before proceeding with this description the concept of the Hammett substituent constant will be described in outline. Hammett's rule is an empirical rule proposed by L. P. Hammett in 1935 for describing quantitatively the effect of substituent groups upon the reactions and equilibria of benzene derivatives. The appropriateness of this rule is now widely accepted. The substituent constants obtained by means of the Hammett rule are $\sigma_p$ values and $\sigma_m$ values and many of these values can be found in general textbooks. Details have been given, for example, by J. A. Dean in *Lange's Handbook of Chemistry,* twelfth edition, 1979 (McGraw-Hill), and in *Kagaku no Ryoiki,* Special Number, 122, 96–103, 1979 (Nankodo). Moreover, in the present invention each substituent is sometimes defined, and sometimes described, by the Hammett substituent $\sigma_p$ constant, and this can be found from the above mentioned textbooks. This is not to say that only the substituent groups of which the value is already known are used in the invention. Even when the value is unreported in the literature, substituent groups are included within the scope of the invention so long as the sums of the Hammett substituent $\sigma$ constants, as determined by Hammett's rule, are within the ranges stated above for $R^1$ and $R_2$, respectively. Hereinafter the $\sigma_p$ and $\sigma_m$ values have the above-defined significance.

Describing $R_1$ and $R_2$ in formula (I) more precisely, $R_1$ can be represented by formula (II) shown below:

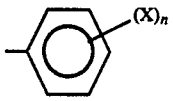

(II)

Wherein X represents a substituent group and n represents an integer of from 1 to 5, and the sum of the Hammett substituent $\sigma$ constants of $-(X)_n$ is at least about 0.2.

More precisely, X represents a halogen atom (e.g., fluorine, chlorine, bromine), a cyan group, a nitro group, a carboxyl group, a sulfonic acid group, an alkyl group (e.g., methyl, ethyl, iso-propyl, tert-butyl), an aryl group (e.g., phenyl, naphthyl), a heterocyclic group (e.g., pyrazolyl, imidazolyl, 2-benzoxazolyl, 2-benzothiazolyl), an alkoxy group (e.g., methoxy, ethoxy, butoxy, dodecyloxy, phenoxyethoxy), an aryloxy group (e.g., phenoxy, naphthoxy, o-chlorophenoxy), an alkylthio group (e.g., methylthio, ethylthio, octylthio, hexadecylthio), an arylthio group (e.g., phenylthio, 2-pivaloylamidophenylthio, p-dodecyloxyphenylthio), an acylamino group (e.g., acetylamino, pivaloylamino, tetradecanoylamino, 2-(2,4-di-tert-amylphenoxy)-butanoylamino, benzoylamino), a carbamoyl group (e.g., N-methylcarbamoyl, N-ethylcarbamoyl, N-dodecylcarbamoyl, N,N-dimethylcarbamoyl,N,N-diethylcarbamoyl,N,N-di-iso-propylcarbamoyl, N,N-di-iso-propylcarbamoyl, N,N-dioctylcarbamoyl, N-cyclohexylcarbamoyl, N-phenylcarbamoyl, N,N-diphenylcarbamoyl), a ureido group (e.g., methylureido, ethylureido, phenylureido), a urethane group (e.g., methylurethane, ethylurethane, propylurethane, butylurethane, phenylurethane), an alkoxycarbonyl group (e.g., methoxycarbonyl, ethoxycarbonyl, propyloxycarbonyl, butoxycarbonyl, dodecyloxycarbonyl, tetradecyloxycarbonyl, hexadecyloxycarbonyl), an imido group (e.g., succinimido, phthalimido), a sulfonamido group (e.g., methanesulfonamido, ethanesulfonamido, butanesulfonamido, dodecanesulfonamido, hexadecanesulfonamido, benzenesulfonamido, p-toluenesulfonamido, 2-butoxy-5-tert-octylbenzenesulfonamido, p-dodecyloxybenzenesulfonamido), a sulfamoyl group (e.g., N-methylsulfamoyl, N-ethylsulfamoyl, N-propylsulfamoyl, N-butylsulfamoyl, N-dodecylsulfamoyl, N-tetradecylsulfamoyl, N-hexadecylsulfamoyl, N-phenylsulfamoyl, N,N-diethylsulfamoyl, N,N-di-iso-propylsulfamoyl, N,N-dioctylsulfamoyl, N,N-diphenylsulfamoyl, N-cyclohexylsulfamoyl), a sulfamoylamino group (e.g., N-ethylsulfamoylamino, N,N-diethylsulfamoylamino, N,N-di-isopropylsulfamoylamino), a sulfonyl group (e.g., methylsulfonyl, ethylsulfonyl, propylsulfonyl, butylsulfonyl, octylsulfonyl, dodecylsulfonyl, phenylsulfonyl), a haloalkyl group (e.g., trichloromethyl, pentachloroethyl) or a carbonyl group (e.g., methylcarbonyl, ethylcarbonyl).

Moreover, n is an integer of from 1 to 5.

In those cases where n is from 2 to 5, the substituent groups X may be the same or different, but the sum of the Hammett substituent constants ( o values) of each of the substituent groups must be at least 0.2.

Typical examples of groups which can be represented by formula (II) are shown below, but the groups are not limited to these examples:

II-1

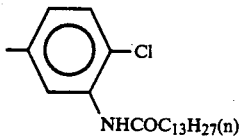

II-2

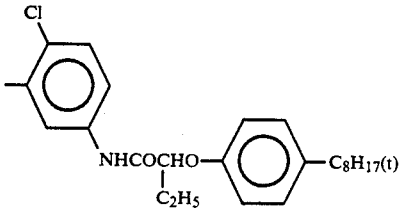

II-3

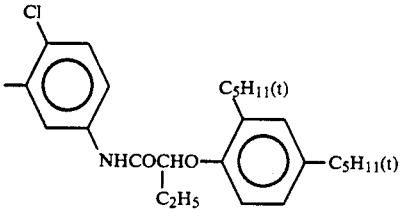

II-4

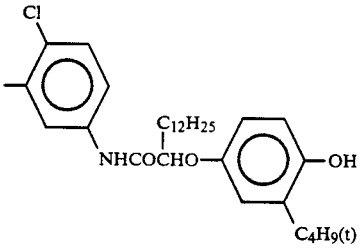

II-5

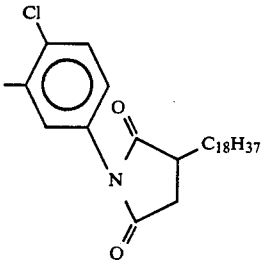

II-6

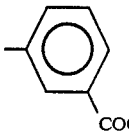

-continued

II-7

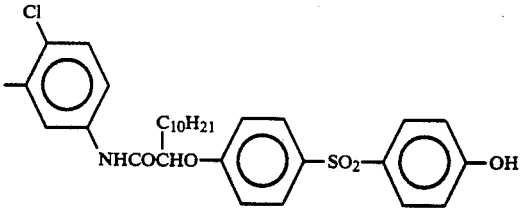

II-8

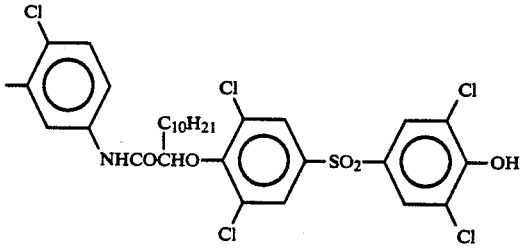

II-9

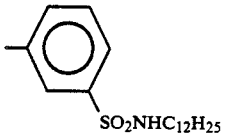

II-10

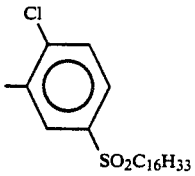

II-11

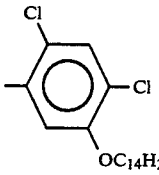

II-12

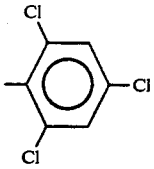

II-13

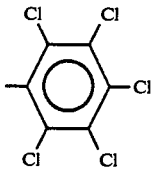

II-14

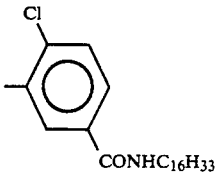

-continued
II-15
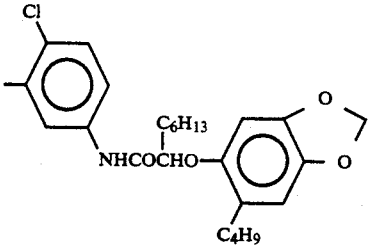
II-16
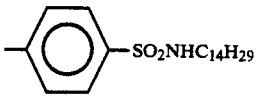
II-17
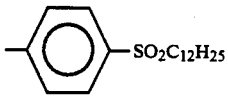
II-18
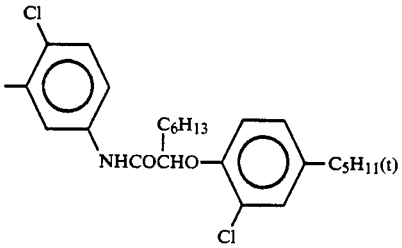
II-19
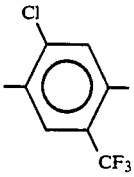
II-20
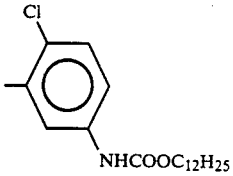
II-21
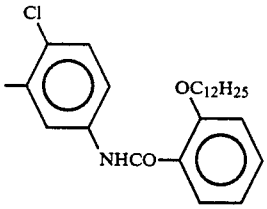
II-22
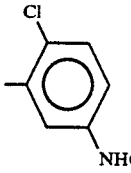
II-23
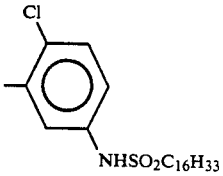
-continued
II-24
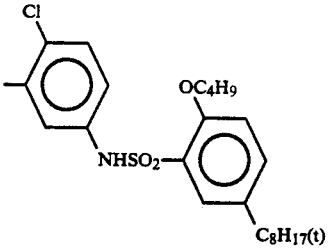
II-25
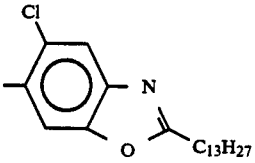
II-26
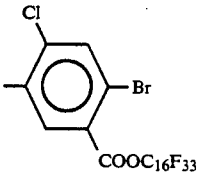
II-27
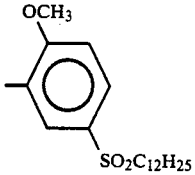
II-28
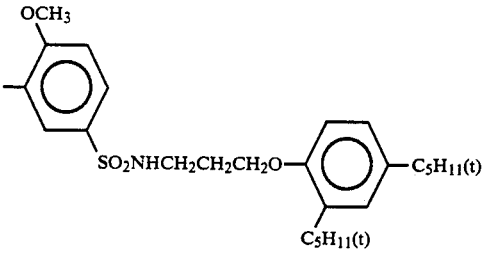
II-29
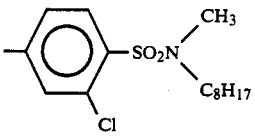
II-30
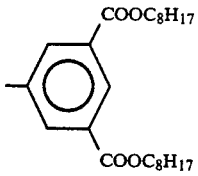
II-31
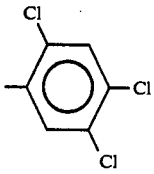

-continued

II-32

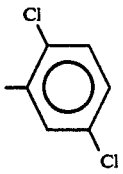

II-33

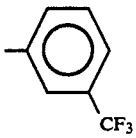

$R_2$ is described below and can be represented by the formula (IV) shown below:

(IV)

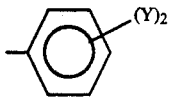

In this formula, Y represents a substituent group; l represents an integer of from 1 to 5; and the $-(Y)_l$ groups are such that the sum of the Hammett substituent $\sigma$ constants is at least about 0.75.

More precisely, Y represents the same substituent groups as described above for the substituent X in formula (II). Moreover, l is an integer of value from 1 to 5, and when l is 2 to 5 the Y groups may be the same or different.

More desirably, $R_2$ is represented by the formula (V) which is shown below.

(V)

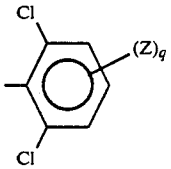

In this formula, Z has the same meaning as the substituent X in formula (II). Moreover, q is an integer of from 1 to 3. However, the substituent groups must be such that the sum of the Hammett substituent $\sigma$ constants of the substituent groups on the benzene ring in formula (V) is at least about 0.75.

Typical examples of groups which can be represented by formula (IV) are shown below, but these groups are not limited to these examples.

IV-1

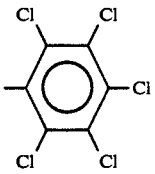

IV-2

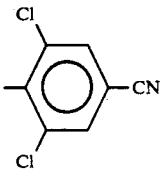

-continued

IV-3

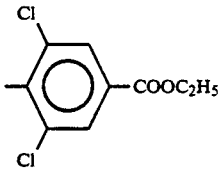

IV-4

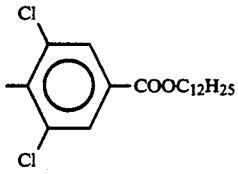

IV-5

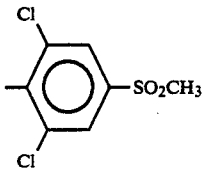

IV-6

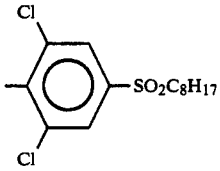

IV-7

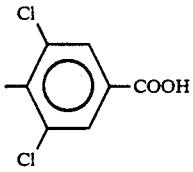

IV-8

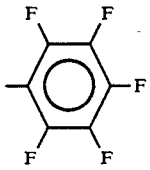

IV-9

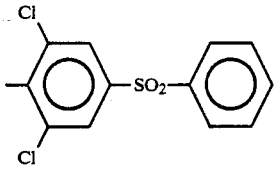

IV-10

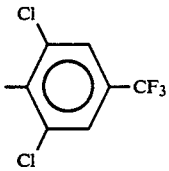

IV-11

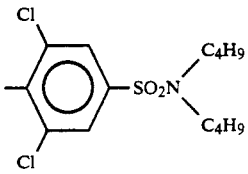

-continued
IV-12
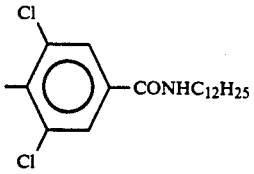
IV-13
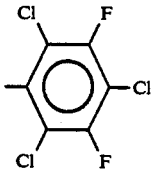
-continued
IV-14
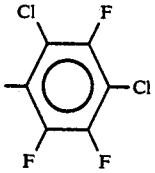
Actual examples of magenta couplers which can be represented by formula (I) are shown below, but these compounds are not limited by these examples.
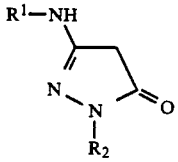
| Illustrative Compound No. | $R_1$ | $R_2$ |
|---|---|---|
| I-1 | 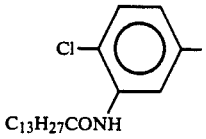 | 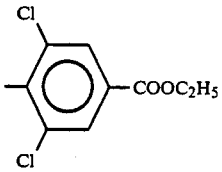 |
| I-2 | " | 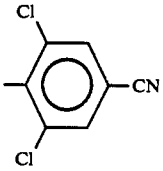 |
| I-3 | " | 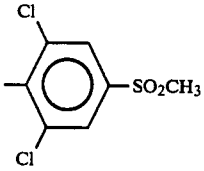 |
| I-4 | " | 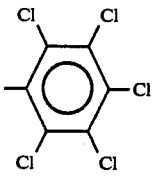 |
| I-5 | " | 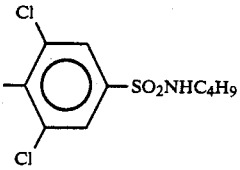 |

-continued
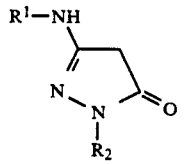
| Illustrative Compound No. | $R_1$ | $R_2$ |
|---|---|---|
| I-6 | " | 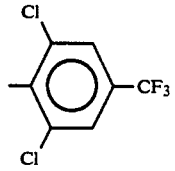 |
| I-7 | 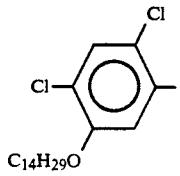 | 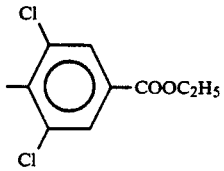 |
| I-8 | 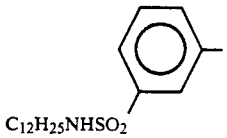 | " |
| I-9 | 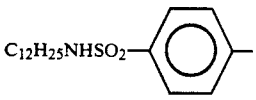 | " |
| I-10 | 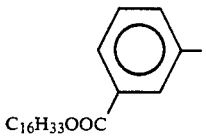 | 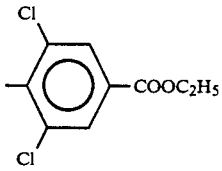 |
| I-11 | 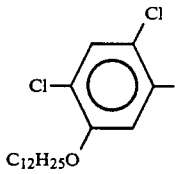 | " |
| I-12 | 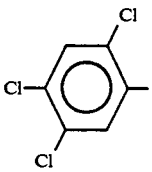 | 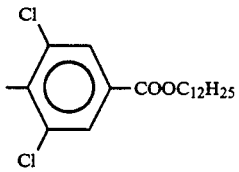 |
| I-13 | 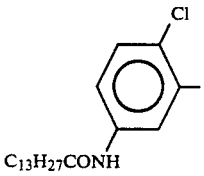 | 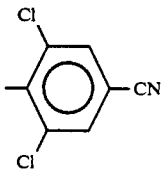 |

-continued
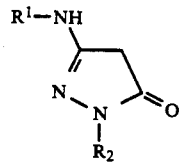
| Illustrative Compound No. | $R_1$ | $R_2$ |
|---|---|---|
| I-14 | 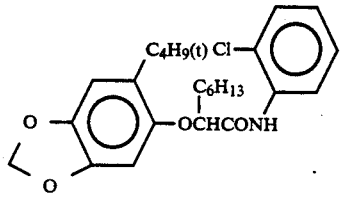 | " |
| I-15 | 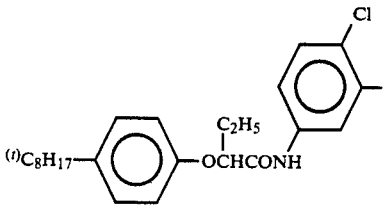 | " |
| I-16 | 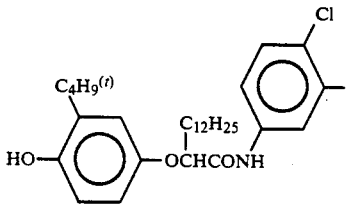 | " |
| I-17 | 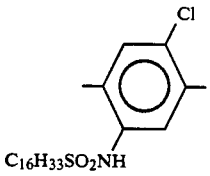 | " |
| I-18 | 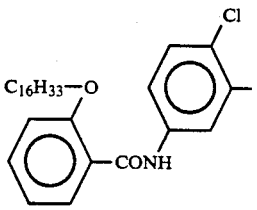 | 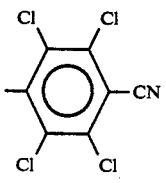 |
| I-19 | 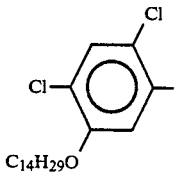 | " |

-continued
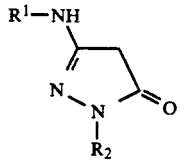
| Illustrative Compound No. | $R_1$ | $R_2$ |
|---|---|---|
| I-20 | 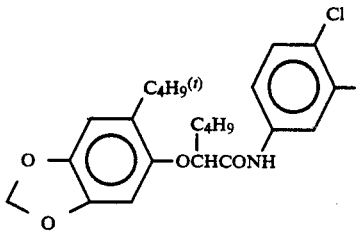  | " |
| I-21 | 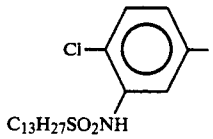  | " |
| I-22 | 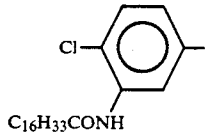  | " |
| I-23 | 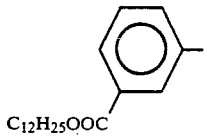  | " |
| I-24 | 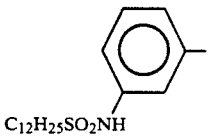  | 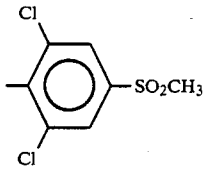  |
| I-25 | 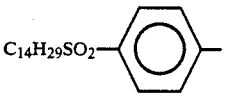  | 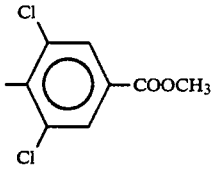  |
| I-26 | " | 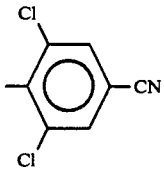  |
| I-27 | 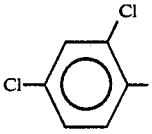  | 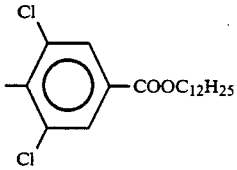  |

-continued
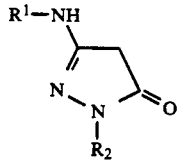
| Illustrative Compound No. | $R_1$ | $R_2$ |
|---|---|---|
| I-28 | 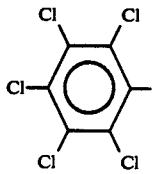 | " |
| I-29 | 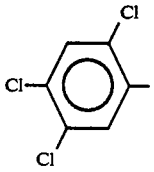 | 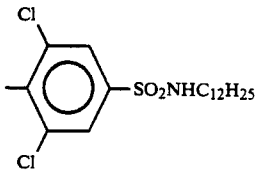 |
| I-30 | 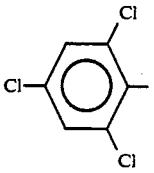 | " |
| I-31 | 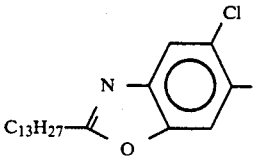 | 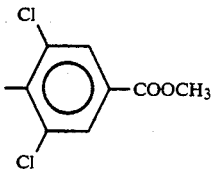 |
| I-32 | 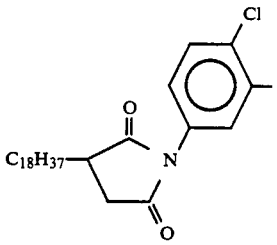 | 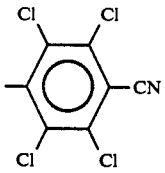 |
| I-34 | 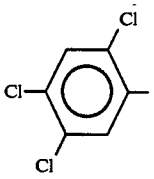 | 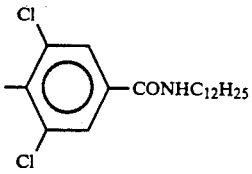 |
| I-35 | 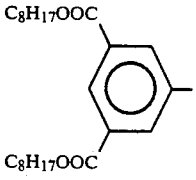 | 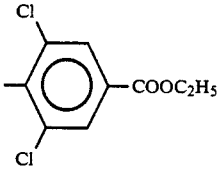 |

-continued
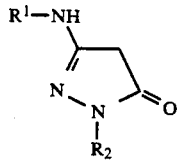
| Illustrative Compound No. | $R_1$ | $R_2$ |
|---|---|---|
| I-36 | " | 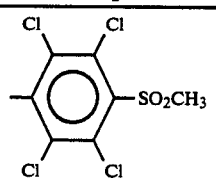 |
| I-37 | 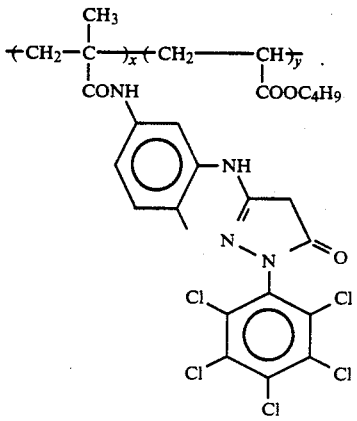 | |
x:y = 50:50 (by weight)
The magenta couplers represented by formula (I) can be prepared using the method disclosed in JP-A-49-111631 (page 5) (Method of Synthesis A) or the method disclosed in U.S. Pat. No. 3,615,506 (Method of Synthesis B).
Method of Synthesis A
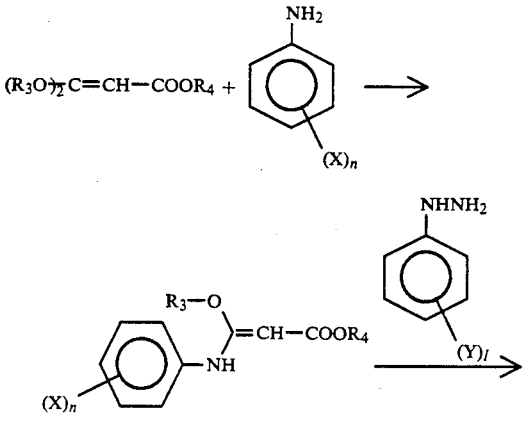
-continued
Method of Synthesis A
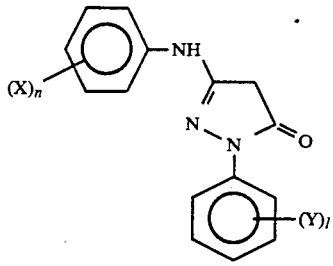
Method of Synthesis B
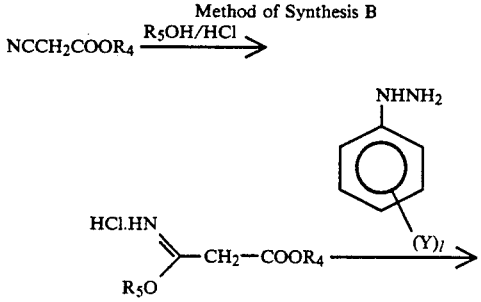

-continued

Method of Synthesis B

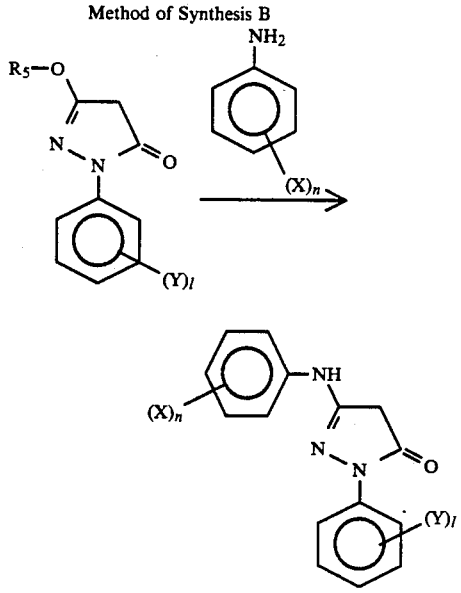

($R_3$, $R_4$ and $R_5$ in these formulae represent alkyl groups.

The compounds of formula (I) are known, as illustrated by JP-B-55-30615, JP-A-62-27731, JP-A-1-147455 and European Patent 0338785A2, but there is no mention of the cases in which these compounds are combined with the specified couplers which can be represented by the formula (M) of the present invention, and no such examples have been disclosed. (The term "JP-B" as used herein signifies an "examined Japanese patent publication")

The couplers represented by the formula (M) are described in detail below. The preferred coupler skeleton from among the coupler skeletons are 1H-imidazo[1,2-b]pyrazole, 1H-pyrazole[1,5-b][1,2,4]-triazole, 1H-pyrazolo[5,1-c][1,2,4]-triazole and 1H-pyrazolo[1,5-d]tetrazole, and these can be represented by the formulae (M-I), (M-II), (M-III) and (M-IV):

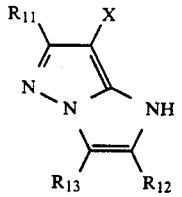

(M-I)

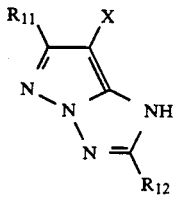

(M-II)

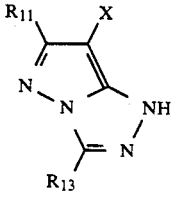

(M-III)

-continued

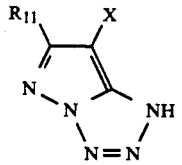

(M-IV)

The substituent groups $R_{11}$, $R_{12}$, $R_{13}$ and X in these formulae are described in detail below.

$R_{11}$ represents a hydrogen atom, a halogen atom, an alkyl group, an aryl group, a heterocyclic group, a cyano group, a hydroxy group, a nitro group, a carboxy group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a cyclohexylthio group, a sulfinyl group, a phosphonyl group, an aryloxycarbonyl group, an acyl group or an azolyl group, and dimers may be formed with $R_{11}$ as a divalent group.

More precisely, the $R_{11}$ groups each represents a hydrogen atom, a halogen atom (e.g., chlorine, bromine, an alkyl group (e.g., a linear or branched chain, alkyl group aralkyl group, alkenyl group, alkynyl group or cycloalkyl group which has from 1 to 32 carbon atoms and, more precisely, for example, methyl, ethyl, propyl, iso-propyl, tert-butyl, tridecyl, 2-methanesulfonylethyl, 3-(3-pentadecylphenoxypropyl, 3-{4-{2-[4-(4-hydroxyphenylsulfonylphenoxy]dodecanamido}-phenyl}propyl, 2-ethoxytridecyl, trifluoromethyl, cyclopentyl, 3-(2,4-di-tert-amylphenoxypropyl, an aryl group (e.g., phenyl, 4-tert-butylphenyl, 2,4-di-tert-amylphenyl, 4-tetradecanamidophenyl), a heterocyclic group (e.g., 2-furyl, 2-thienyl, 2-pyrimidyl, 2-benzothiazolyl), a cyano group, a hydroxy group, a nitro group, a carboxy group, an amino group, an alkoxy group (e.g., methoxy, ethoxy, 2-methoxyethoxy, 2-dodecylethoxy, 2-methanesulfonylethoxy), an aryloxy group (e.g., phenoxy, 2-methylphenoxy, 4-tert-butylphenoxy, 3-nitrophenoxy, 3-tert-butyloxycarbamoylphenoxy, 3-methoxycarbamoyl phenoxy), an acylamino group (e.g., acetamido, benzamido, tetradecanamido, 2-(2,4-di-tert-amylphenoxybutanamido,4-(3-tert-butyl-4-hydroxyphenoxybutanamido, 2-{4-(4-hydroxyphenylsulfonylphenoxy}-decanamido), an alkylamino group (e.g., methylamino, butylamino, dodecylamino, diethylamino, methylbutylamino), an anilino group (e.g., phenylamino, 2-chloroanilino, 2-chloro-5-tetradecanaminoanilino, 2-chloro-5-dodecyloxycarbonylanilino, N-acetylanilino,2-chloro-5-{α-(3-tert-butyl-4-hydroxyphenoxydodecanamido}anilino), a ureido group (e.g., phenylureido, methylureido, N,N-dibutylureido), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-tert-butylphenoxy)propylthio), an arylthio group (e.g., phenylthio, 2-butoxy-5-tert-octylphenylthio, 3-pentadecylphenylthio, 2-carboxyphenylthio, 4-tetradecanamidophenylthio), an alkoxycarboyylamino group (e.g., methoxycarbonylamino, tetradecyloxycarbonylamino), a sulfonamido group (e.g., methanesulfonamido, hexadecanesulfonamido, benzenesulfonamido, p-toluenesulfonamido, octadecanesulfonamido, 2-methyloxy-5-tert-butylbenzenesulfonamido), a carbamoyl group (e.g., N-ethylcarbamoyl, N,N-dibutylcarbamoyl, N-(2-dodecyloyethylcarbamoyl, N-methyl-N-dodecylcarbamoyl, N-{3-(2,4-di-tert-amylphenoxy)propyl}carbamoyl), a sulfamoyl group (e.g., N-ethylsulfamoyl, N,N-dipropylsulfamoyl, N-(2-dodecyloxyethylsulfamoyl, N-ethyl-N-dodecylsulfamoyl, N,N-diethylsulfamoyl), a sulfonyl group (e.g., methanesulfonyl, octanesulfonyl, benzenesulfonyl, toluenesulfonyl), an alkoxycarbonyl group (e.g., methoxycarbonyl, butoxycarbonyl, dodecyloxycarbonyl, octadecyloxycarbonyl), a heterocyclic oxy group (e.g., 1-phenyltetrazole-5-oxy, 2-tetrahydropyranyloxy), an azo group (e.g., phenylazo, 4-methoxyphenylazo, 4-pivaloylaminophenylazo, 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethylsilyloxy, dibutylmethylsilyloxy), an aryloxycarbonylamino group (e.g., phenoxycarbonylamino), an imido group (e.g.,N-succinimido,N-phthalimido, 3-octadecenylsuccinimido), a heterocyclic thio group (e.g., 2-benzothiazolylthio, 2,4-di-phenoxy-1,3,5-triazolyl-6-thio, 2-pyridylthio), a sulfinyl group (e.g., dodecanesulfinyl, 3-pentadecylphenylsulfinyl, 3-phenoxypropylsulfinyl), a phosphonyl group (e.g., phenoxyphosphonyl, octyloxyphosphonyl, phenylphosphonyl), an aryloxycarbonyl group(e.g., phenoxycarbonyl), an acyl group (e.g., acetyl, 3-phenylpropanoyl, benzoyl, 4-dodecyloxybenzoyl) or an azolyl group (e.g., imidazolyl, pyrazolyl, 3-chloropyrazol-1-yl, triazolyl). Those of these groups which can have further substituent groups may have organic substituent groups or halogen atoms bonded to a carbon atom, an oxygen atom, a nitrogen atom or a sulfur atom.

From among these substituent groups, the alkyl groups, aryl groups, alkoxy groups, aryloxy groups, alkylthio groups, ureido groups, urethane groups and acylamino groups are preferred for $R_{11}$.

$R_{12}$ has the same meaning as $R_{11}$, and it is preferably a hydrogen atom, an alkyl group, an aryl group, a heterocyclic group, an alkoxycarbonyl group, a carbamoyl group, a sulfamoyl group, a sulfinyl group, an acyl group or a cyano group.

Furthermore, $R_{13}$ has the same meaning as $R_{11}$, and it is preferably a hydrogen atom, an alkyl group, an aryl group, a heterocyclic group, an alkoxy group, an aryloxy group, an alkylthio group, an arylthio group, an alkoxycarbonyl group, a carbamoyl group or an acyl group, and it is most desirably an alkyl group, an aryl group, a heterocyclic group, an alkylthio group or an arylthio group.

X represents a hydrogen atom or a group which can be eliminated (split off) in a reaction with an oxidation product of a primary aromatic amine color developing agent, and more precisely the leaving group X is, for example, a halogen atom, an alkoxy group, an aryloxy group, an acyloxy group, an alkyl or aryl sulfonyloxy group, an acylamino group, an alkyl or aryl sulfonamido group, an alkoxycarbonyloxy group, an aryloxycarbonyloxy group, an alkyl, aryl or heterocyclic thio group, a carbamoylamino group, a five-or six-membered nitrogen-containing heterocyclic group, an imido group or an arylazo group, and these groups may be further substituted with the groups which are permissible as substituent groups for $R_{11}$.

More precisely, the groups represented by X include halogen atoms (e.g., fluorine, chlorine, bromine), alkoxy groups (e.g., ethoxy, decyloxy, methoxyethylcarbamoylmethoxy, carboxypropyloxy, methylsulfonylethoxy, ethoxycarbonylmethoxy), aryloxy groups (e.g., 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), acyloxy groups (e.g., acetoxy, tetradecanoyloxy, benzoyloxy), alkyl or aryl sulfonyloxy groups (e.g., methanesulfonyloxy, toluenesulfonyloxy), acylamino groups (e.g., dichloroacetylamino, pentafluorobutylamino), alkyl or aryl sulfonamido groups (e.g., methanesulfonamino, trifluoromethanesulfonamino, p-toluenesulfonamino), alkoxycarbonyloxy groups (e.g., ethoxycarbonyloxy, benzyloxycarbonyloxy), aryloxycarbonyloxy groups (e.g., phenoxycarbonyloxy), alkyl, aryl or heterocyclic thio groups (e.g., dodecylthio, 1-carboxydodecylthio, phenylthio, 2-butoxy-5-tert-octylphenylthio, tetrazolylthio), carbamoylamino groups (e.g.,N-methylcarbamoylamino, N-phenylcarbamoylamino),five-or six-membered nitrogen containing heterocyclic groups (e.g., imidazolyl, pyrazolyl, triazolyl, tetrazolyl, 1,2-dihydro-2-oxo-1-pyridyl), imido groups (e.g., succinimido, hydantoinyl) and arylazo group (e.g., phenylazo, 4-methoxyphenylazo). There are also cases in which X may take the form of a dimeric coupler for which four-equivalent couplers are condensed with an aldehyde or a ketone with X as a leaving group which is bonded via a carbon atom. Furthermore, X may contain a photographically useful group such as a development inhibitor or a development accelerator. X is preferably a halogen atom, an alkoxy group, an aryloxy group, an alkyl or aryl thio group or a five-or six-membered nitrogen containing heterocyclic group which is bonded to the coupling position via a nitrogen atom.

Illustrative magenta couplers which can be represented by formula (M) are shown below, but these compounds are not limited to these examples.

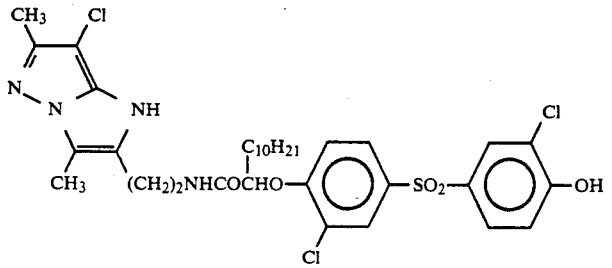

(M-1)

-continued
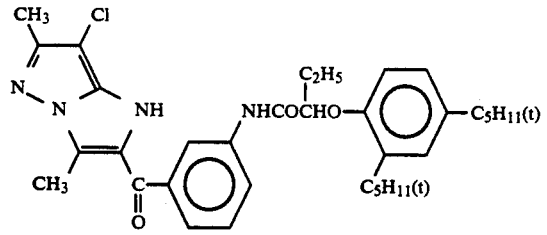
(M-2)
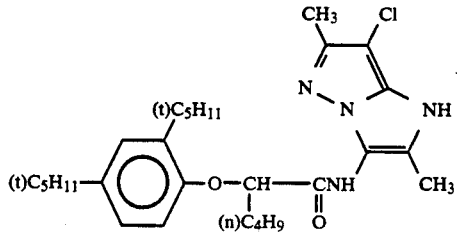
(M-3)
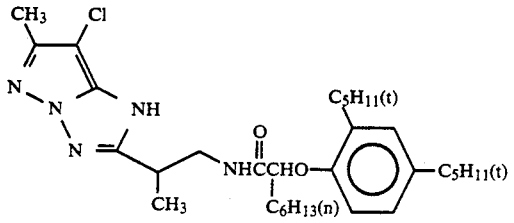
(M-4)
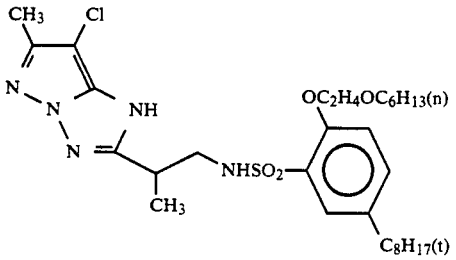
(M-5)
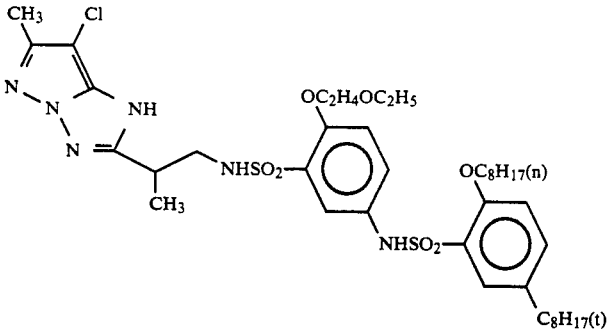
(M-6)
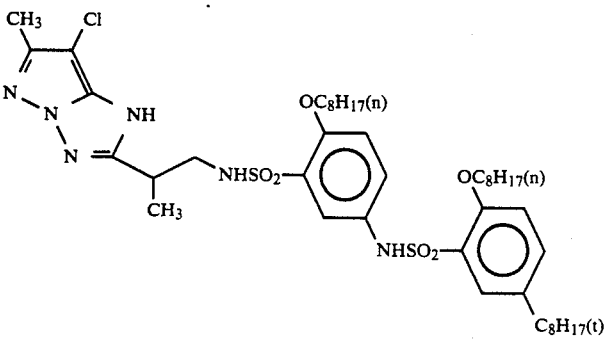
(M-7)

-continued
(M-8)
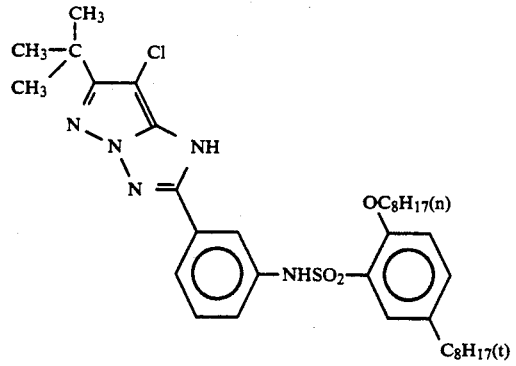
(M-9)
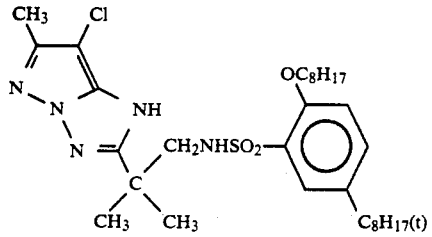
(M-10)
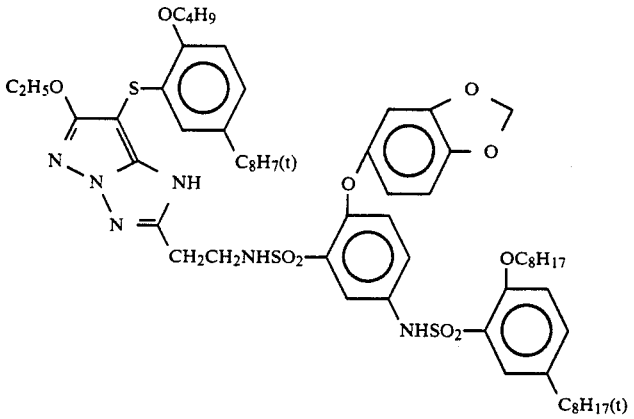
(M-11)
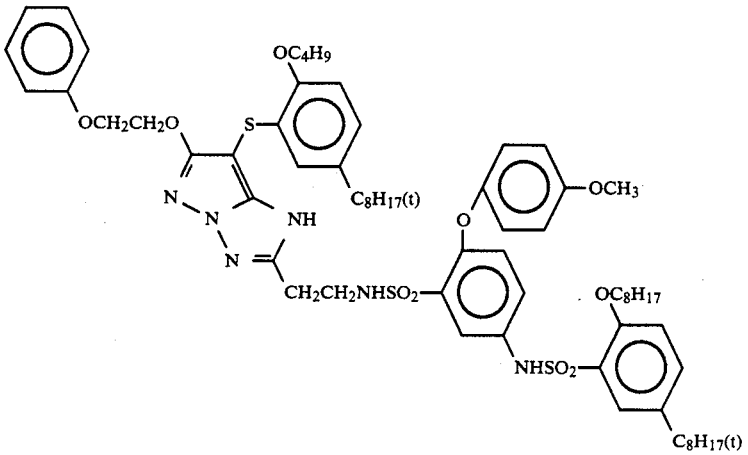

-continued
(M-12)
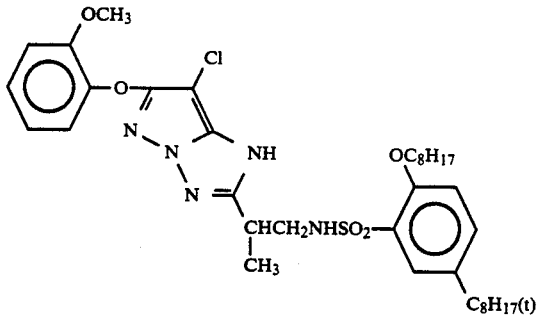
(M-13)
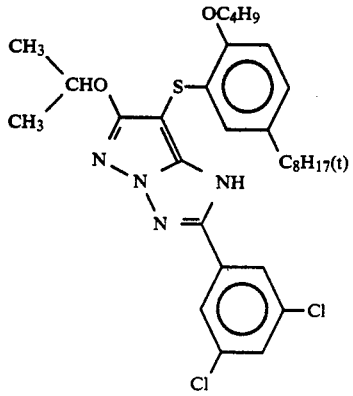
(M-14)
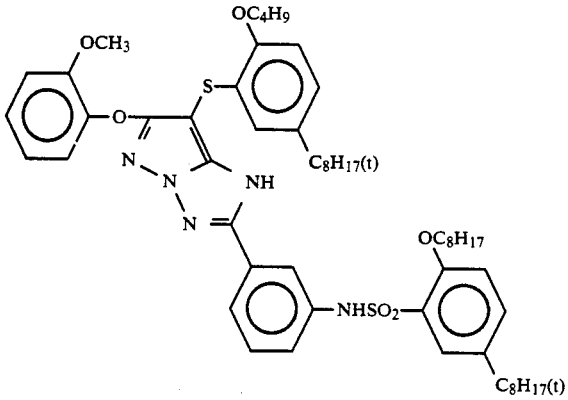
(M-15)
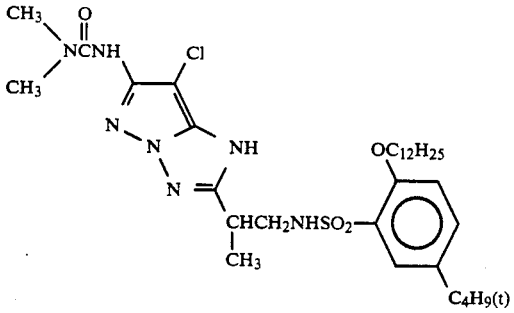
(M-16)
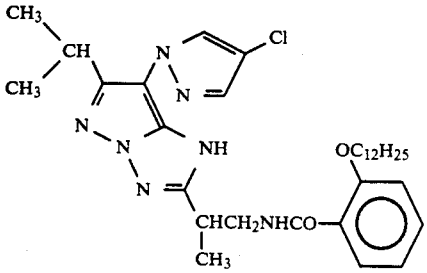

-continued
(M-17)
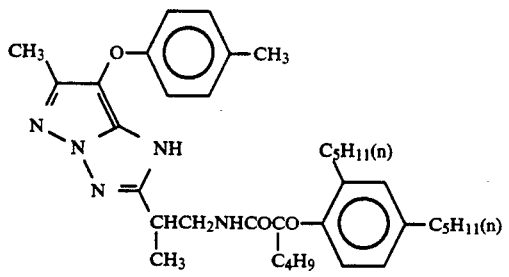
(M-18)
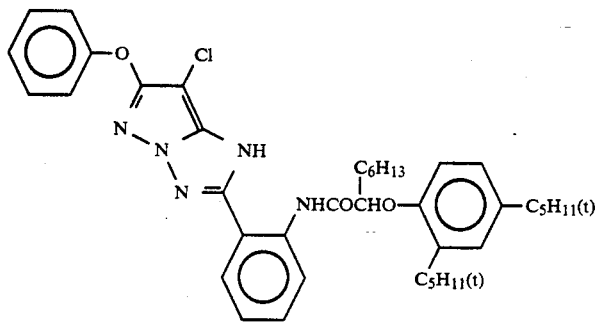
(M-19)
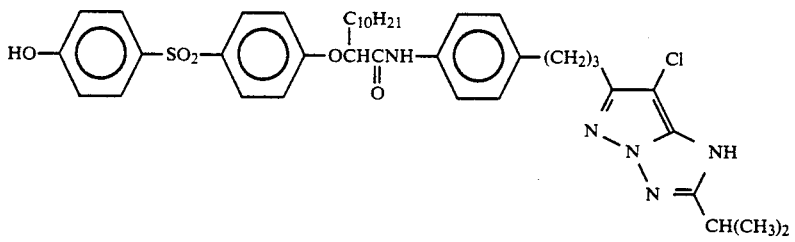
(M-20)
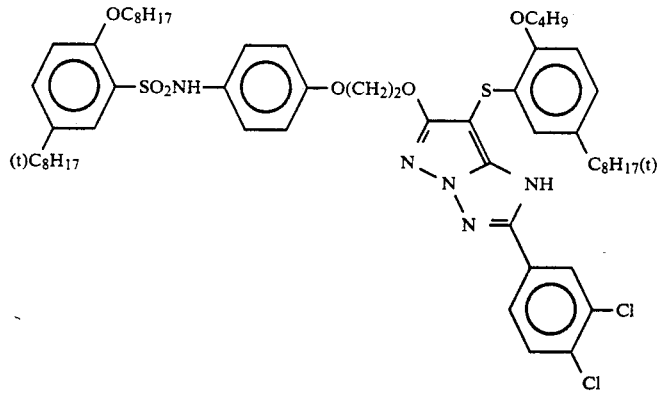
(M-21)
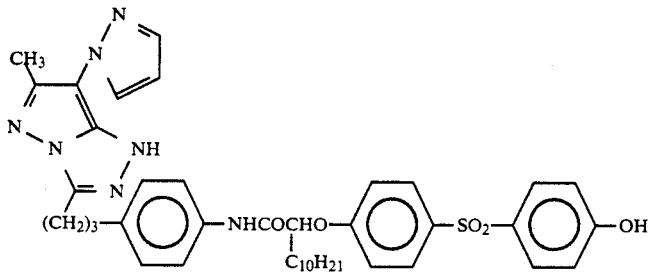

-continued
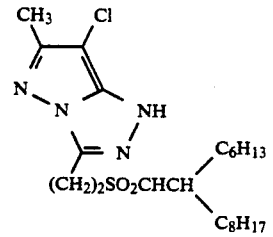
(M-22)
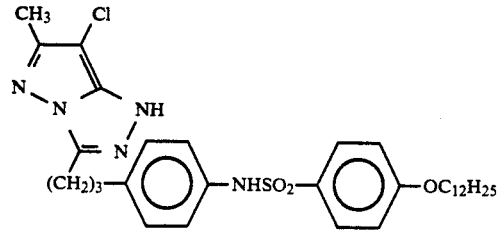
(M-23)
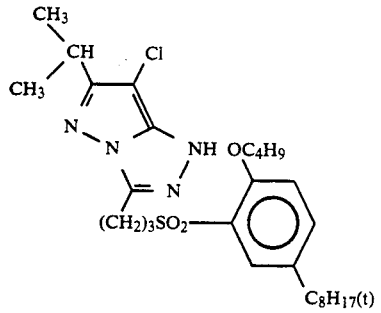
(M-24)
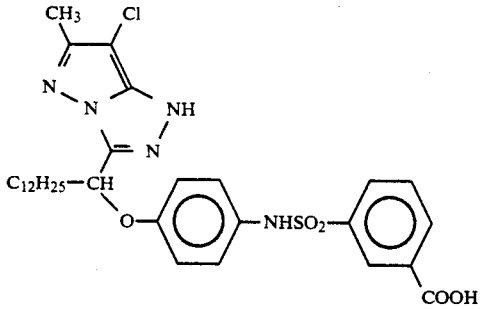
(M-25)
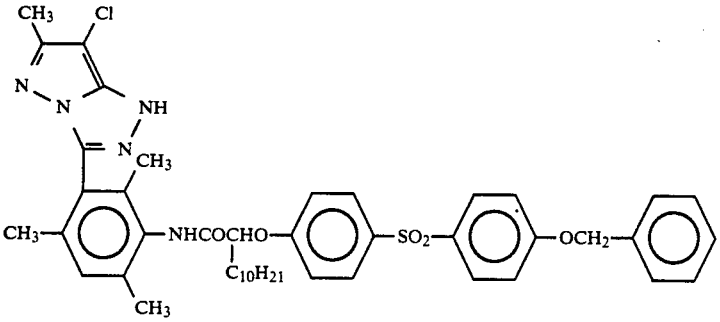
(M-26)

-continued
(M-27)
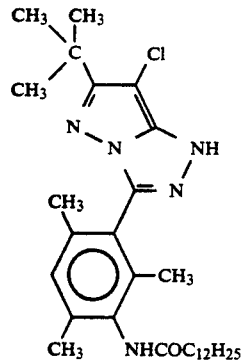
(M-28)
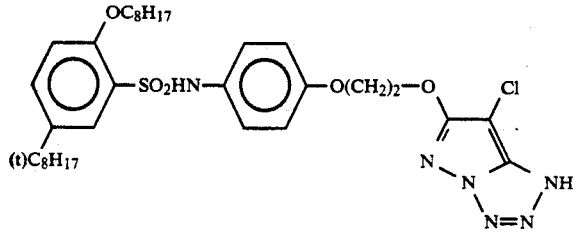
(M-29)
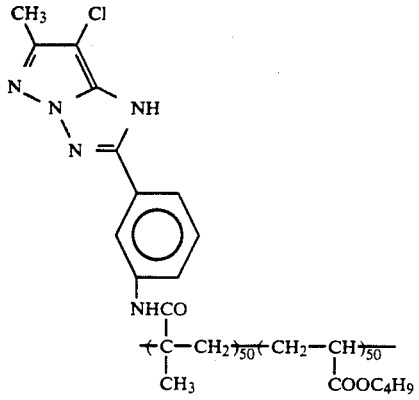
(M-30)
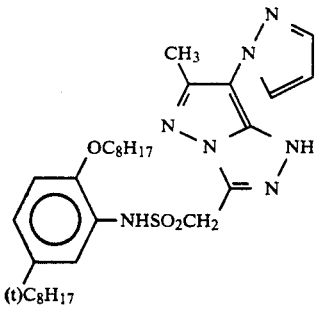
(M-31)
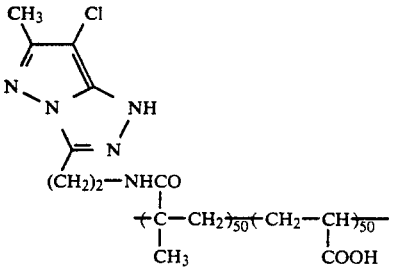
50:50 are wt % numbers.

Literature in which methods for the preparation of couplers which can be represented by general formula (M) is discussed below.

Compounds of formula (M-I) can be prepared using the method disclosed, for example, in U.S. Pat. No. 4,500,630; compounds of formula (M-II) can be prepared using the methods disclosed, for example, in U.S. Pat. Nos. 4,540,654 and 4,705,863, JP-A-61-65245, JP-A-62-209457 and JP-A-62-249155; compounds of formula (M-III) can be prepared using the methods disclosed, for example, in JP-B-47-27411 and U.S. Pat. No. 3,725,067; and compounds of formula (M-IV) can be prepared using the methods disclosed, for example, in JP-A-60-33552.

The layers to which the couplers represented by formulae (I) and (M) of the present invention are added are preferably green sensitive emulsion layers or non-photosensitive intermediate layers which are adjacent thereto. Furthermore, the couplers represented by formulae (I) and (M) are preferably used in the form of mixtures provided that there is no loss of the effect of the invention. The couplers of formulae (I) and (M) are generally used in amounts of from about 0.01 mmol to about 1 mmol, and preferably in amounts of from about 0.1 mmol to about 0.5 mmol, per square meter of photosensitive material.

The photosensitive material of the present invention should have established on a support at least one blue sensitive silver halide emulsion layer, green sensitive silver halide emulsion layer and red sensitive silver halide emulsion layer, but no particular limitation is imposed upon the number or order of the silver halide emulsion layers and non-photosensitive layers. Typically, a silver halide photographic photosensitive material has, on a support, at least one photosensitive layer unit comprised of a plurality of silver halide emulsion layers which have essentially the same color sensitivity but different photographic speeds, the photosensitive layer unit being a photosensitive layer unit which is color sensitive to blue light, green light or red light, and in a multi-layer silver halide color photographic material the arrangement of the photosensitive layer units generally involves their establishment in the order, from the support side, of a red sensitive layer unit, a green sensitive layer unit, and a blue sensitive layer unit. However, this order may be reversed, as required, and the layers may be arranged in such a way that a layer which has a different color sensitivity is sandwiched between layers which have the same color sensitivity.

Various non-photosensitive layers, such as intermediate layers for example, may be established between the above mentioned silver halide photosensitive layers, and as uppermost and lowermost layers.

The intermediate layers may contain couplers and DIR compounds such as those disclosed in the specifications of JP-A-61-43748, JP-A-59-113438, JP-A-59-113440, JP-A-61-20037 and JP-A-61-20038, and they may also contain the generally used anti-color mixing compounds.

The plurality of silver halide emulsion layers constituting each photosensitive layer unit is preferably a double layer structure comprised of a high speed emulsion layer and a low speed emulsion layer as disclosed in West German Patent 1,121,470 or British Patent 923,045. Generally, arrangements in which the photographic speed is lower in the layer closer to the support are preferred, and non-photosensitive layers may be established between each of the silver halide emulsion layers. Furthermore, the low speed layers may be arranged on the side furthest away from the support and the high speed layers may be arranged on the side closest to the support as disclosed, for example, in JP-A-57-112751, JP-A-62-200350, JP-A-62-206541 and JP-A-62-206543.

In practical terms, the arrangement may be, from the side furthest from the support, low spaced blue sensitive layer (BL/high speed blue sensitive layer (BH/high speed green sensitive layer (GH/low speed green sensitive layer (GL/high speed red sensitive layer (RH/low speed red sensitive layer (RL, or BH/BL/GL/GH/RH/RL, or BH/BL/GH/GL/RL/RH.

Furthermore, the layers can be arranged in the order, from the side furthest from the support, of blue sensitive layer/GH/RH/GL/RL as disclosed in JP-B-55-34932. Furthermore, the layers can also be arranged in the order, from the side furthest away from the support, of blue sensitive layer/GL/RL/GH/RH, as disclosed in the specifications of JP-A-56-25738 and JP-A-62-63936.

Furthermore, there are arrangements in which there are three layers which have different speeds with the photosensitivity falling towards the support with the silver halide emulsion layer of the highest photosensitivity at the top, a silver halide emulsion layer which has a lower photosensitivity than the aforementioned layer as an intermediate layer and a silver halide emulsion layer which has a lower photosensitivity than the intermediate layer as a bottom layer, as disclosed in JP-B-49-15495. In the case of structures of this type which have three layers with different photosensitivities, the layers in a layer of the same color sensitivity may be arranged in the order, from the side furthest from the support, of intermediate speed emulsion layer/high speed emulsion layer/low speed emulsion layer, as disclosed in the specification of JP-A-59-202464.

Furthermore, the layers can be arranged in the order of high speed emulsion layer/low speed emulsion layer-/intermediate speed emulsion layer, or low speed emulsion layer/intermediate speed emulsion layer/high speed emulsion layer, for example.

Furthermore, the arrangement may be varied in the ways indicated above in cases where there are four or more layers.

As described above, various layer structures and arrangements can be selected respectively according to the purpose of the photosensitive material.

The preferred silver halides for inclusion in the photographic emulsion layers of the photographic photosensitive material used in the present invention are silver iodobromides, silver iodochlorides or silver iodochlorobromides which contain not more than about 30 mol % of silver iodide. Most desirably, the silver halide is a silver iodobromide or silver iodochlorobromide which contains from about 2 mol % to about 10 mol % of silver iodide.

The silver halide grains in the photographic emulsion may have a regular crystalline form such as a cubic, octahedral or tetradecahedral form, an irregular crystalline form such as a spherical or plate-like form, a form which has crystal defects such as twinned crystal planes, or a form which is a composite of these forms.

The grain size of the silver halide may be very fine with a projected area diameter of less than about 0.2 microns, or large with a projected area diameter of up to about 10 microns, and the emulsions may be polydisperse emulsions or monodisperse emulsions.

Silver halide photographic emulsions which can be used in the present invention can be prepared, for example, using the methods disclosed in *Research Disclosure* (RD No. 17643 (December, 1978, pages 22–23, "I. Emulsion Preparation and Types", *Research Disclosure* 18716 (November 1979, page 648, and *Research Disclosure,* No. 307105 (November 1989, pages 863–865, by P. Glafkides in *Chimie et Physique Photographique,* published by Paul Montel, 1967, by G. F. Duffin in *Photographic Emulsion Chemistry,* published by Focal Press, 1966, and by V. L. Zelikmann et al. in *Making and Coating Photographic Emulsions,* published by Focal Press, 1964.

The monodisperse emulsions disclosed, for example, in U.S. Pat. Nos. 3,574,628 and 3,655,394, and in British Patent 1,413,748, are also desirable.

Furthermore, tabular grains which have an aspect ratio of at least about 3 can also be used in the present invention. Tabular grains can be prepared easily using the methods described, for example, by Gutoff in *Photographic Science and Engineering,* Volume 14, pages 248–257 (1970, and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions, or the grains may have a layer-like structure and, moreover, silver halides which have different compositions may be joined with an epitaxial junction or they may be joined with compounds other than silver halides, such as silver thiocyanate or lead oxide, for example. Furthermore, mixtures of grains which have various crystalline forms may be used.

The above mentioned emulsions may be of the surface latent image type with which the latent image is formed principally on the surface, of the internal latent image type in which the latent image is formed within the grains, or of a type with which the latent image is formed both at the surface and within the grains, but a negative type emulsion is necessary. From among the internal latent image types the emulsion may be a core/shell internal latent image type emulsion as disclosed in JP-A-63-264740. A method for the preparation of such a core/shell internal latent image type emulsion has been disclosed in JP-A-59-133542. The thickness of the shell of the emulsion differs according to development processing for example, but it is preferably from about 3 to about 40 nm, and most desirably from about 5 to about 20 nm.

The silver halide emulsions used have generally been subjected to physical ripening, chemical ripening and spectral sensitization. Additives which are used in such processes have been disclosed in *Research Disclosure* Nos. 17643, 18716 and 307105, and the locations of these disclosures are summarized in the table provided hereinafter.

Two or more different types of emulsion which differ in terms of at least one of the characteristics of grain size, grain size distribution or halogen composition of the photosensitive silver halide emulsion, the grain form or photographic speed can be used in the form of a mixture in the same layer in a photosensitive material of the present invention.

The use of essentially non-photosensitive hydrophilic colloid layers and/or photosensitive silver halide emulsion layers containing silver halide grains of which the grain surface has been fogged as disclosed in U.S. Pat. No. 4,082,553, silver halide grains of which the grain interior has been fogged as disclosed in U.S. Pat. No. 4,626,498 and JP-A-59-214852 or colloidal silver is desirable. Silver halide grains of which the grain interior or surface has been fogged are grains which can be developed uniformly (not in the form of the image irrespective of whether they are in an unexposed part or an exposed part of the photosensitive material. Methods for the preparation of silver halide grains of which the interior or surface of the grains has been fogged have been disclosed in U.S. Pat. No. 4,626,498 and JP-A-59-214852.

In the silver halide which forms the internal nuclei of core/shell type silver halide grains of which the interior has been fogged the core and the shell may have the same halogen composition or the different halogen compositions. The silver halide of which the interior or surface of the grains has been fogged may be silver chloride, silver chlorobromide, silver iodobromide or silver chloroiodobromide. No particular limitation is imposed upon the grain size of these fogged silver halide grains, but an average grain size of from about 0.01 to about 0.75 μm, and especially of from about 0.05 to about 0.6 μm, is preferred. Furthermore, no particular limitation is imposed upon the form of the grains and they may be regular grains, and they may be polydisperse emulsions, but monodisperse emulsions (in which at least about 95% in terms of the weight or number of silver halide grains have a grain size within ±40% of the average grain size are preferred.

The use of non-photosensitive fine grained silver halides is desirable in the present invention. Non-photosensitive fine grained silver halides are fine grained silver halides which are not photosensitive at the time of the imagewise exposure for obtaining the dye image and which undergo essentially no development during development processing, and those which have not been pre-fogged are preferred.

The non-photosensetive fine grained silver halide has a silver bromide content from 0 to 100 mol % and may contain silver chloride and/or silver iodide as required. Those which have a silver iodide content of from about 0.5 to about 10 mol % are preferred.

The non-photosensitive fine grained silver halide has an average grain size (the average value of the diameters of the circles corresponding to the projected areas preferably of from about 0.01 to about 0.5 μm, and most desirably of from about 0.02 to about 0.2 μm.

The non-photosensitive fine grained silver halide can be prepared using the same methods as used in general for the preparation of photosensitive silver halides. In this case, the surface of the silver halide grains does not need to be optically sensitized and neither is there any need for spectral sensitization. However, it is preferred that the known stabilizers such as triazole, azaindene, benzothiazolium or mercapto based compounds or zinc compounds are added to the coating liquid and the fine grained silver halide is then added thereto. Colloidal silver can also be included desirably in the layer which contains these non-photosensitive fine grained silver halide grains.

The coated weight of silver in the photosensitive material of the present invention is preferably not more than about 6.0 g/m$^2$, and most desirably not more than about 4.5 g/m$^2$.

Known photographically useful additives which can be used in the present invention have been disclosed in the three *Research Disclosures* referred to above, and the locations of these disclosures are indicated in the table below.

| Type of Additive | RD17643 (December 1978) | RD18716 (November 1979) | RD307105 (November 1989) |
|---|---|---|---|
| 1. Chemical Sensitizers | Page 23 | Page 648, right hand column | Page 866 |
| 2. Speed Increasing Agents | | Page 648, right hand column | |
| 3. Spectral Sensitizers, Supersensitizers | Pages 23-24 | Page 648 right hand column - page 649 right hand column | Pages 866-868 |
| 4. Bleaching Agents | Page 24 | Page 647, right hand column | Page 868 |
| 5. Antifoggants, Stabilizers | Pages 24-25 | Page 649, right hand column | Pages 868-870 |
| 6. Light Absorbers, Filter Dyes and Ultraviolet absorbers | Pages 25-26 | Page 649, right hand column - page 650, left hand column | Page 873 |
| 7. Anti-staining Agents | Page 25, right hand | Page 650, left hand column - right hand column | Page 872 |
| 8. Dye Image Stabilizers | Page 25 | page 650, left hand column | Page 872 |
| 9. Film Hardening Agents | Page 26 | Page 651, left hand column | Pages 874-875 |
| 10. Binders | Page 26 | Page 651, left hand column | Pages 873-874 |
| 11. Plasticizers, Lubricants | Page 27 | Page 650, right hand column | Page 876 |
| 12. Coating promoters Surfactants | Pages 26-27 | Page 650, right hand column | Pages 875-876 |
| 13. Antistatic Agents | Page 27 | Page 650, right hand column | Pages 876-877 |
| 14. Matting Agents | | | Pages 878-879 |

Furthermore, addition of the compounds disclosed in U.S. Pat. Nos. 4,411,987 and 4,435,503 which can react with and fix formaldehyde to the photosensitive material is desirable for preventing deterioration of photographic performance due to formaldehyde gas.

Various color couplers can be used in the present invention, and actual examples have been disclosed in the patents cited in the aforementioned *Research Disclosure* No. 17643, sections VII-C-G and *Research Disclosure* No. 307105, sections VII-C-G.

Those disclosed, for example, in U.S. Pat. Nos. 3,933,501, 4,022,620, 4,326,024, 4,401,752 and 4,248,961, JP-B-58-10739, British Patents 1,425,020 and 1,467,760, U.S. Pat. Nos. 3,973,968, 4,314,023 and 4,511,649, and European Patent 249,473A are preferred as yellow couplers.

Phenol and naphthol based couplers can be cited as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid Open 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred.

Typical examples of polymerized dye forming couplers have been disclosed, for example, in U.S. Pat. Nos. 3,451,820, 4,080,211, 4,367,282, 4,409,320 and 4,576,910, British Patent 2,102,137 and European Patent 341,188A.

The coullers disclosed in U.S. Pat. No. 4,366,237, British Patent 2,125,570, European Patent 96,570 and West German Patent (Laid Open) 3,234,533 are preferred as couplers of which the colored dyes have a suitable degree of diffusibility.

The colored couplers for correcting the unwanted absorptions of colored dyes disclosed, for example, in section VII-G of *Research Disclosure* No. 17643, section VII-G of *Research Disclosure* No. 307105, U.S. Pat. No. 4,163,670, JP-B-57-39413, U.S. Pat. Nos. 4,004,929 and 4,138,258, and British Patent 1,146,368 are desirable. Furthermore, the use of couplers which correct the unwanted absorption of colored dyes by means of fluorescent dyes which are released on coupling as disclosed in U.S. Pat. No. 4,774,181, and couplers which have, as leaving groups, dye precursor groups which can form dyes on reaction with the developing agent as disclosed in U.S. Pat. No. 4,777,120, is also desirable.

The use of compounds which release photographically useful residual groups on coupling is also desirable in the present invention. The DIR couplers which release development inhibitors disclosed in the patents cited in section VII-F of the aforementioned *Research Disclosure* 17643 and section VII-F of *Research Disclosure* No. 307105, JP-A-57-151944, JP-A-57-154234, JP-A-60-184248, JP-A-63-37350 and U.S. Pat. Nos. 4,248,962 and 4,782,012 are preferred.

The couplers disclosed in British Patents 2,097,140 and 2,131,188, JP-A-59-157638 and JP-A-59-170840 are preferred as couplers which imagewise release nucleating agents or development accelerators during development.

Other compounds which can be used in photosensitive materials of the present invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compound releasing couplers, DIR coupler releasing couplers, DIR coupler releasing redox compounds or DIR redox releasing redox compounds disclosed, for example, in JP-A-60-185950 and JP-A-62-24252, the couplers which release dyes of which the color is restored after release disclosed in European Patents 173,302A and 313,308A, the bleach accelerator releasing couplers disclosed, for example, in *Research Disclosure* Nos. 11449 and 24241, and JP-A-61-201247, the ligand releasing couplers disclosed, for example, in U.S. Pat. No. 4,555,477, the leuco dye releasing couplers disclosed in JP-A-63-75747, and the couplers which release fluorescent dyes disclosed in U.S. Pat. No. 4,774,181.

The couplers used in the present invention can be introduced into the photosensitive material using various known methods of dispersion, such as the oil-in-water dispersion method or the latex dispersion method.

Examples of high boiling point solvents which can be used in the oil-in-water dispersion method have been disclosed, for example, in U.S. Pat. No. 2,322,027.

Actual examples of high boiling point organic solvents which have a boiling point of at least 175° C. at normal pressure which can be used in the oil-in-water dispersion method include phthalic acid esters (e.g., dibutyl phthalate, dicyclohexyl phthalate, di-2-ethylhexyl phthalate, decyl phthalate, bis(2,4-di-tert-amylphenylphthalate, bis(2,4-di-tert-amylphenylisophthalate and bis(1,1-diethylpropylphthalate), phosphoric acid or phosphonic acid esters (e.g., triphenyl phosphate, tricresyl phosphate, 2-ethylhexyl diphenyl phosphate, tricyclohexyl phosphate, tri-2-ethylhexyl phosphate, tridodecyl phosphate, tri-butoxyethyl phosphate, trichloropropyl phosphate and di-2-ethylhexyl phenyl phosphonate), benzoic acid esters (e.g., 2-ethylhexyl benzoate, dodecyl benzoate, 2-ethylhexyl p-hydroxybenzoate), amides (e.g., N,N-diethyldodecanamide, N,N-diethyllaurylamide and N-tetradecylpyrrolidone), alcohols or phenols (e.g., iso-stearyl alcohol and 2,4-di-tert-amylphenol), aliphatic carboxylic acid esters (e.g., bis(2-ethylhexyl)sebacate, dioctyl azelate, glycerol tributyrate, iso-stearyl lactate and trioctyl citrate), aniline derivatives (e.g., N,N-dibutyl-2-butoxy-5-tert-octylaniline) and hydrocarbons (e.g., paraffins, dodecylbenzene and diisopropylnaphthalene). Furthermore, organic solvents which have a boiling point above about 30° C., and preferably of at least about 50° C., but below about 160° C. can be used as auxiliary solvents, and typical examples of these solvents include ethyl acetate, butyl acetate, ethyl propionate, methyl ethyl ketone, cyclohexanone, 2-ethoxyethyl acetate and dimethylformamide.

The processes and effects of the latex dispersion method and actual examples of latexes for loading purposes have been disclosed, for example, in U.S. Pat. Nos. 4,199,363, and in West German Patent Applications (OLS 2,541,274 and 2,541,230.

The addition to the color photosensitive materials of the present invention of various fungicides and biocides such as phenethyl alcohol and 1,2-benzisothiazolin-3-one, n-butyl p-hydroxybenzoate, phenol, 4-chloro-3,5-dimethylphenol, 2-phenoxyethanol and 2-(4-thiazolylbenzimidazole for example as disclosed in JP-A-63-257747, JP-A-62-272248 and JP-A-1-80941 is desirable.

The present invention can be applied to various types of color photosensitive materials. Typical examples include color negative films for general and cinematographic purposes, color reversal films for slides and television purposes, color papers, color positive films and color reversal papers.

Suitable supports which can be used in the present invention have been disclosed, for example, on page 28 of the aforementioned *Research Disclosure* No. 17643, from the right hand column of page 647 to the left hand column of page 648 of *Research Disclosure* No. 18716, and on page 879 of *Research Disclosure* No. 307105

The photosensitive materials of the present invention are such that the total film thickness of all the hydrophilic colloid layers on the side where the emulsion layers are located is preferably not more than 28 μm, more desirably not more than about 23 μm, even more desirably not more than about 18 μm, and most desirably not more than 16 μm. Furthermore, the film swelling rate $T_{\frac{1}{2}}$ is preferably not more than about 30 seconds and most desirably not more than about 20 seconds. Here, the film thickness signifies the film thickness measured under conditions of about 25° C., about 55% relative humidity (2 days and the film swelling rate $T_{\frac{1}{2}}$ is that measured using the methods well known to those in the industry. For example, measurements can be made using a swellometer of the type described by A. Green in *Photogr. Sci. Eng.*, Volume 19, Number 2, pages 124–129, and $T_{\frac{1}{2}}$ is defined as the time taken to reach half the saturated film thickness, taking 90% of the maximum swelled film thickness reached on processing the material for 3 minutes 15 seconds in a color developer at 30° C., as the saturated film thickness.

The film swelling rate $T_{\frac{1}{2}}$ can be adjusted by adding film hardening agents for the gelatin which is used as a binder, or by changing the ageing conditions after coating. Furthermore, a swelling factor of from about 150% to about 400% is preferred. The swelling factor can be calculated from the maximum swollen film thickness obtained under the conditions described above using the expression (maximum swollen film thickness - film thickness)/film thickness.

Color photographic photosensitive materials which are in accordance with the present invention can be developed and processed using the general methods disclosed on pages 28–29 of the aforementioned *Research Disclosure* No. 17643, from the left hand column to the right hand column of page 615 of the aforementioned *Research Disclosure* No. 18716, and on pages 880 to 881 of *Research Disclosure* No. 307105.

The color developers used for the development processing of photosensitive materials of the present invention are preferably aqueous alkaline solutions which contain a primary aromatic amine based color developing agent as the principal component. Aminophenol based compounds are also useful as color developing agents but the use of p-phenylenediamine based compounds is preferred, and typical examples include 3-methyl-4-amino-N,N-diethylaniline, 3-methyl-4-amino-N-ethyl-N-β -hydroxyethylaniline,3-methyl-4-amino-N-ethyl-N-62 -methanesulfonamidoethylaniline, 3-methyl-4-amino-N-ethyl-β-methoxyethylaniline and the sulfate, hydrochloride and p-toluenesulfonate salts of these compounds. From among these compounds, 3-methyl-4-amino-N-ethyl-N-β-hydroxyethylaniline sulfate is especially desirable. Two or more of these compounds can be used conjointly, as required.

The color developer generally contains pH buffers such as alkali metal carbonates, borates or phosphates, and development inhibitors or antifoggants such as chloride, bromide, iodide, benzimidazoles, benzothiazoles or mercapto compounds. The color developer may also contain, as required, various preservatives such as hydroxylamine, diethylhydroxylamine, sulfite, hydrazines such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, thickeners and various chelating agents as typified by the aminopolycarboxylic acids, aminopolyphosphonic acids, alkylphosphonic acids and phosphonocarboxylic acids, typical examples of which include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid and salts of these acids.

Furthermore, color development is carried out after normal black-and-white development in the case of reversal processing. Known black-and-white developing agents including dihydroxybenzenes such as hydroquinone; 3-pyrazolidones such as 1-phenyl-3-pyrazolidone; and aminophenols such as N-methyl-p-aminophenol, for example, can be used individually, or in combinations, in the black-and-white developer.

The pH of these color developers and black-and-white developers is generally from about 9 to about 12. Furthermore, the replenishment rate for these developers depends on the color photographic photosensitive material which is being processed but, in general, it is not more than about 3 liters per square meter of photosensitive material, and it can be set to not more than about 500 ml by reducing the bromide ion concentration in the replenisher. In those cases where the replenishment rate is low it is desirable that evaporation and aerial oxidation of the liquid should be prevented by minimizing the area of contact with the air in the processing tank.

The contact area between the air and the photographic processing bath in a processing tank can be represented by the opening factor which is defined below. Thus:

$$\text{Opening Factor} = \frac{\text{Contact Area Between Processing bath and Air } (cm^2)}{\text{Processing Bath Volume } (cm^3)}$$

The above mentioned opening factor is preferably not more than about 0.1, and most desirably from about 0.001 to about 0.05. As well as the establishment of a shielding material such as a floating lid on the surface of the photographic processing bath in the processing tank, the method involving the use of a movable lid as disclosed in JP-A-1-82033 and the method involving slit development processing disclosed in JP-A-63-216050 can be used as a means of reducing the opening factor. Reduction of the opening factor is preferably applied not only to the processes of color development and black-and-white development but also to all the subsequent processes, such as the bleaching, bleach-fixing, fixing, water washing and stabilizing processes. Furthermore, the replenishment rate can be reduced by using some means of suppressing the accumulation of bromide ion in the development bath.

The color development processing time is generally between about 2 and about 5 minutes, but shorter processing times can be devised by increasing the pH or by increasing the concentration of the color developing agent.

The photographic emulsion layer is generally subjected to a bleaching process and a fixing process after color development to effect de-silvering. The bleaching process may be carried out at the same time as the fixing process (in a bleach-fix process) or it may be carried out separately. Moreover, methods in which a bleach-fix process is carried out after a bleaching process may be used in order to speed up processing. Moreover, processing can be carried out in two connected bleach-fix baths, a fixing process can be carried out before a bleach-fixing process or a bleaching process can be carried out after a bleach-fixing process, as required.

Compounds of multi-valent metals, such as iron (III) for example, peracids, quinones and nitro compounds, for example, can be used as bleaching agents. Typical bleaching agents include organic complex salts of iron (III), for example complex salts with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid, or citric acid, tartaric acid or malic acid for example. From among these materials, the use of polyaminocarboxylic acid iron (III) complex salts, and principally of ethylenediaminetetraacetic acid iron (III) complex salts and 1,3-diaminopropanetetraacetic acid iron (III) salts, is preferred from the points of view of both rapid processing and the prevention of environmental pollution. Moreover, the aminopolycarboxylic acid iron (III) complex salts are especially useful in both bleach baths and bleach-fix baths. The pH value of the bleach baths and bleach-fix baths in which these aminopolycarboxylic acid iron (III) salts are used is generally from about 4.0 to about 8, but lower pH values can be used in order to speed up processing.

Bleaching accelerators can be used, as required, in the bleach baths, bleach-fix baths or bleach or bleach-fix prebaths. Actual examples of useful bleach accelerators have been disclosed in the following specifications: Thus there are, for example, the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-95630, JP-A-53-95631, JP-A-53-104232, JP-A-53-124424, JP-A-53-141623, JP-A-53-28426, and *Research Disclosure* No. 17129 (July 1978; the thiazolidine derivatives disclosed in JP-A-50-140129; the thiourea derivatives disclosed in JP-B-45-8506, JP-A-52-20832, JP-A-53-32735 and U.S. Pat. No. 3,706,561, the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-40943, JP-A-49-59644, JP-A-53-94927, JP-A-54-35727, JP-A-55-26506 JP-A-58-163940; and the bromide ion. From among these compounds those which have a mercapto group or a disulfide group are preferred in view of their large accelerating effect, and the compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleaching accelerators may be added to the photosensitive materials. These bleaching accelerators are especially effective when bleach-fixing camera color photosensitive materials.

The inclusion of organic acids as well as the compounds indicated above in the bleach baths and bleach-fix baths is desirable for preventing the occurrence of bleach staining. Compounds which have an acid dissociation constant (pKa) of from about 2 to about 5 are especially desirable for the organic acids, and in practice acetic acid and propionic acid, for example, are preferred.

Thiosulfate, thiocyanate, thioether based compounds, thioureas and large amounts of iodide can be used, for example, as the fixing agent which is used in a fixer or bleach-fixer, but thiosulfate is generally used, and ammonium thiosulfate in particular can be used in the widest range of applications. Furthermore, the conjoint use of thiosulfate and thiocyanate, thioether compounds, thiourea etc. is also desirable. Sulfite, bisulfite, carbonyl/bisulfite addition compounds or the sulfinic acid compounds disclosed in European Patent 294,769A are preferred as preservatives for fixers and bleach-fixers. Moreover, the addition of various aminopolycarboxylic acids and organophosphonic acids to the fixing baths and bleach-fixing baths is desirable for stabilizing these baths.

The addition of compounds of pKa from about 6.0 to about 9.0 and preferably imidazoles such as imidazole, 1-methylimidazole, 1-ethylimidazole and 2-methylimidazole in amounts of from about 0.1 to about 10 mol/liter to the fixer or bleach-fixer is desirable in the present invention.

A shorter total desilvering processing time within the range where desilvering failure does not occur is preferred. The desilvering time is preferably from about 1 to about 3 minutes, and most desirably from about 1 to about 2 minutes. Furthermore, the processing temperature is from about 25° C. to about 50° C., and preferably from about 35° C. to about 45° C. The desilvering rate is increased and the occurrence of staining after processing is effectively prevented within the preferred temperature range.

As much agitation as possible is desirable during the desilvering process. Actual examples of methods of strong agitation include the methods in which a jet of processing liquid is made to impinge on the emulsion surface of the photosensitive material as disclosed in JP-A-62-183460, the method in which the agitation effect is increased using a rotary device as disclosed in JP-A-62-183461, the method in which the photosensitive material is moved with a wiper blade which is established in the bath in contact with the emulsion surface and the agitation effect is increased by the generation of turbulence at the emulsion surface, and the method in which the circulating flow rate of the processing bath as a whole is increased. These means of increasing agitation are effective in bleach baths, bleach-fix baths and fixing baths. It is thought that increased agitation increases the rate of supply of bleaching agent and fixing agent to the emulsion film and consequently increases the de-silvering rate. Furthermore, the aforementioned means of increasing agitation are more effective in cases where a bleaching accelerator is being used, and they sometimes provide a marked increase in the accelerating effect and eliminate the fixer inhibiting action of the bleaching accelerator.

The automatic processors which are used for photosensitive materials of the present invention preferably have photosensitive material transporting devices as disclosed in JP-A-60-191257, JP-A-60-191258 or JP-A-60-191259. With such a transporting device, for example that disclosed in the aforementioned JP-A-60-191257, the carry-over of processing liquid from one bath to the next is greatly reduced and this is very effective for preventing deterioration in processing bath performance. These effects are especially useful for shortening the processing time in each process and for reducing the replenishment rate of each processing bath.

The silver halide color photographic photosensitive materials of the present invention are generally subjected to a water washing process and/or stabilizing process after the desilvering process. The amount of wash water used in the washing process can be fixed within a wide range, depending on the application and the nature (depending on the materials such as couplers which have been used for example) of the photosensitive material, the wash water temperature, the number of water washing tanks (the number of water washing stages and the replenishment system, i.e. whether a counter flow or a sequential flow system is used, and various other conditions. The relationship between the amount of water used and the number of washing tanks in a multi-stage counter-flow system can be obtained using the method outlined on pages 248–253 of the *Journal of the Society of Motion Picture and Television Engineers*, Volume 64 (May 1955).

The amount of wash water used can be greatly reduced by using the multi-stage counter-flow system noted in the aforementioned reference, but bacteria proliferate due to the increased residence time of the water in the tanks and problems arise with the suspended matter which is produced becoming attached to the photosensitive material. The method in which the calcium ion and magnesium ion concentrations are reduced, disclosed in JP-A-62-288838, is very effective as a means of overcoming this problem when processing color photosensitive materials of the present invention. Furthermore, the isothiazolone compounds and thiabendazoles disclosed in JP-A-57-8542, the chlorine based disinfectants such as chlorinated sodium isocyanurate, and benzotriazole, for example, and the disinfectants disclosed in *The Chemistry of Biocides and Fungicides* by Horiguchi, (1986, Sanko Shuppan, in *Killing Micro-organisms, Biocidal and Fungicidal Techniques* (1982 published by the Health and Hygiene Technology Society, and in *A Dictionary of Biocides and Fungicides* (1986 published by the Japanese Biocide and Fungicide Society, can also be used in this connection.

The pH value of the washing water when processing photosensitive materials of the present invention is from about 4 to about 9, and preferably from about 5 to about 8. The washing water temperature and the washing time can be set variously in accordance with the nature and application of the photosensitive material but, in general, washing conditions of from about 20 seconds to about 10 minutes at a temperature of from about 15° C. to about 45° C., and preferably of from about 30 seconds to about 5 minutes at a temperature of from about 25° C. to about 40° C., are selected. Moreover, the photosensitive materials of this invention can be processed directly in a stabilizing bath instead of being subjected to a water wash as described above. The known methods disclosed in JP-A-57-8543, JP-A-58-14834 and JP-A-60-220345 can be used for a stabilization process of this type.

Furthermore, there are also cases in which a stabilization process is carried out following the aforementioned water washing process, and the stabilizing baths which contain dye stabilizing agents and surfactants which are used as final baths with camera color photosensitive materials are an example of such a process. Aldehydes such as formalin and glutaraldehyde, N-methylol compounds, hexamethylenetetramine and aldehyde/sulfurous acid adducts can be used, for example, as dye stabilizing agents.

Various chelating agents and fungicides can also be added to these stabilizing baths.

The overflow which accompanies replenishment of the above mentioned water washing and/or stabilizing baths can be reused in other processes such as the de-silvering process for example.

Concentration correction with the addition of water is desirable in cases where the above mentioned processing baths become concentrated due to evaporation when processing in an automatic processor for example.

Color developing agents may be incorporated into the silver halide color photosensitive material of the present invention with a view to simplifying and speeding up processing. The incorporation of various color developing agent precursors is preferred. For example, the indoaniline based compounds disclosed in U.S. Pat. No. 3,342,597, the Shiff's base type compounds disclosed in U.S. Pat. No. 3,342,599, *Research Disclosure* No. 14850 and *Research Disclosure* No. 15159, the aldol compounds disclosed in *Research Disclosure* No. 13924, the metal complex salts disclosed in U.S. Pat. No. 3,719,492 and the urethane based compounds disclosed in JP-A-53-135628 can be used for this purpose.

Various 1-phenyl-3-pyrazolidones may be incorporated, as required, into the silver halide color photosensitive material of the present invention with a view to accelerating color development. Typical compounds have been disclosed, for example, in JP-A-56-64339, JP-A-57-144547 and JP-A-58-115438.

The various processing baths in the present invention are used at a temperature of from about 10° C. to about 50° C. The standard temperature is generally from about 33° C. to about 38° C., but accelerated processing and shorter processing times can be realized at higher temperatures while, on the other hand, increased picture quality and improved processing bath stability can be achieved at lower temperatures.

Furthermore, the silver halide photosensitive materials of the present invention can also be used as the heat developable photosensitive materials disclosed, for example, in U.S. Pat. No. 4,500,626, JP-A-60-133449, JP-A-59-218443, JP-A-61-238056 and European Patent 210,660A2.

The invention is described in detail below by means of illustrative examples, but the invention is not limited by these examples.

EXAMPLE 1

Preparation of Sample 101

A multi-layer color photosensitive material comprised of layers of which the compositions are indicated below was prepared on a cellulose triacetate film support of thickness 127 μ on which an under-layer had been established, and this was taken as Sample 101. The numbers indicate the amounts added per square meter. Moreover, the effect of the compounds added is not limited to the cited application.

| | |
|---|---|
| First Layer: Anti-halation Layer | |
| Black colloidal silver | 0.25 g |
| Gelatin | 1.9 g |
| Ultraviolet absorber U-1 | 0.04 g |
| Ultraviolet absorber U-2 | 0.1 g |
| Ultraviolet absorber U-3 | 0.1 g |
| Ultraviolet absorber U-4 | 0.1 g |
| Ultraviolet absorber U-6 | 0.1 g |
| High boiling point organic solvent Oil-1 | 0.1 g |
| Second Layer: Intermediate Layer | |
| Gelatin | 0.40 g |
| Compound Cpd-D | 10 mg |
| High boiling point organic solvent Oil-3 | 0.1 g |
| Dye D-4 | 0.4 mg |
| Third Layer: Intermediate Layer | |
| Fine grained silver iodobromide emulsion of which the surface and interior had been fogged (average gain size 0.06 μm, variation coefficient 18%, AgI content 1 mol %) as silver | 0.05 g |
| Gelatin | 0.4 g |
| Fourth Layer: Low Speed Red Sensitive Emulsion Layer | |
| Emulsion A as silver | 0.2 g |
| Emulsion B as silver | 0.3 g |
| Gelatin | 0.8 g |
| Coupler C-1 | 0.15 g |
| Coupler C-2 | 0.05 g |
| Coupler C-9 | 0.05 g |
| Compound Cpd-D | 10 mg |
| High boiling point organic solvent Oil-2 | 0.1 g |

-continued

| | |
|---|---|
| Fifth Layer: Medium Speed Red Sensitive Emulsion Layer | |
| Emulsion B as silver | 0.2 g |
| Emulsion C as silver | 0.3 g |
| Gelatin | 0.8 g |
| Coupler C-1 | 0.2 g |
| Coupler C-2 | 0.05 g |
| Coupler C-3 | 0.2 g |
| High boiling point organic solvent Oil-2 | 0.1 g |
| Sixth Layer: High Speed Red Sensitive Emulsion Layer | |
| Emulsion D as silver | 0.4 g |
| Gelatin | 1.1 g |
| Coupler C-1 | 0.3 g |
| Coupler C-3 | 0.7 g |
| Additive P-1 | 0.1 g |
| Seventh Layer: Intermediate Layer | |
| Gelatin | 0.6 g |
| Additive M-1 | 0.3 g |
| Anti-color mixing agent Cpd-K | 2.6 mg |
| Ultraviolet absorber U-1 | 0.1 g |
| Ultraviolet absorber U-6 | 0.1 g |
| Dye D-1 | 0.02 g |
| Eighth Layer: Intermediate Layer | |
| Fine grained silver iodobromide emulsion of which the surface and interior had been fogged (average gain size 0.06 μm, variation coefficient 16%, AgI content 0.3 mol % as silver | 0.02 g |
| Gelatin | 1.0 g |
| Additive P-1 | 0.2 g |
| Anti-color mixing agent Cpd-J | 0.1 g |
| Anti-color mixing agent Cpd-A | 0.1 g |
| Ninth Layer: Low Speed Green Sensitive Emulsion Layer | |
| Emulsion E as silver | 0.3 g |
| Emulsion F as silver | 0.1 g |
| Emulsion G as silver | 0.1 g |
| Gelatin | 0.5 g |
| Coupler C-7 | 0.28 g |
| Compound Cpd-B | 0.03 g |
| Compound Cpd-D | 10 mg |
| Compound Cpd-E | 0.02 g |
| Compound Cpd-F | 0.02 g |
| Compound Cpd-G | 0.02 g |
| Compound Cpd-H | 0.02 g |
| High boiling point organic solvent Oil-1 | 0.1 g |
| High boiling point organic solvent Oil-2 | 0.1 g |
| Tenth Layer: Medium Speed Green Sensitive Emulsion Layer | |
| Emulsion G as silver | 0.3 g |
| Emulsion H as silver | 0.1 g |
| Gelatin | 0.6 g |
| Coupler C-4 | 0.25 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| High boiling point organic solvent Oil-2 | 0.01 g |
| Eleventh Layer: High Speed Green Sensitive Emulsion Layer | |
| Emulsion I as silver | 0.5 g |
| Gelatin | 1.0 g |
| Coupler C-4 | 0.5 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High boiling point organic solvent Oil-1 | 0.02 g |
| High boiling point organic solvent Oil-2 | 0.02 g |
| Twelfth Layer: Intermediate Layer | |
| Gelatin | 0.6 g |
| Dye D-1 | 0.1 g |
| Dye D-2 | 0.05 g |
| Dye D-3 | 0.07 g |
| Thirteenth Layer: Yellow Filter Layer | |
| Yellow colloidal silver as silver | 0.1 g |
| Gelatin | 1.1 g |

-continued

| | |
|---|---|
| Anti-color mixing agent Cpd-A | 0.01 g |
| High boiling point organic solvent Oil-1 | 0.01 g |
| Fourteenth Layer: Intermediate Layer | |
| Gelatin | 0.6 g |
| Fifteenth Layer: Low Speed Blue Sensitive Emulsion Layer | |
| Emulsion J as silver | 0.4 g |
| Emulsion K as silver | 0.1 g |
| Emulsion L as silver | 0.1 g |
| Gelatin | 0.8 g |
| Coupler C-5 | 0.6 g |
| Sixteenth layer: Medium Speed Blue Sensitive Emulsion Layer | |
| Emulsion L as silver | 0.1 g |
| Emulsion M as silver | 0.4 g |
| Gelatin | 0.9 g |
| Coupler C-5 | 0.3 g |
| Coupler C-6 | 0.3 g |
| Seventeenth Layer: High Speed Blue Sensitive Emulsion Layer | |
| Emulsion N as silver | 0.4 g |
| Gelatin | 1.2 g |
| Coupler C-6 | 0.7 g |
| Eighteenth Layer: First Protective Layer | |
| Gelatin | 0.7 g |
| Ultraviolet absorber U-1 | 0.04 g |
| Ultraviolet absorber U-2 | 0.01 g |
| Ultraviolet absorber U-3 | 0.03 g |
| Ultraviolet absorber U-4 | 0.03 g |
| Ultraviolet absorber U-5 | 0.05 g |
| Ultraviolet absorber U-6 | 0.05 g |
| High boiling point organic solvent Oil-1 | 0.02 g |

-continued

| | |
|---|---|
| Formalin scavenger | |
| Cpd-C | 0.2 g |
| Cpd-I | 0.4 g |
| Dye D-3 | 0.05 g |
| Nineteenth Layer: Second Protective Layer | |
| Colloidal silver as silver | 0.1 mg |
| Fine grained silver iodobromide emulsion (average grain size 0.06 μm, AgI content 1 mol %) as silver | 0.1 g |
| Gelatin | 0.4 g |
| Twentieth Layer: Third Protective Layer | |
| Gelatin | 0.4 g |
| Poly(methyl methacrylate (average particle size 1.5μ) | 0.1 g |
| Methyl methacrylate/acrylic acid (4:6 copolymer (average particle size 1.5 μ) | 0.1 g |
| Silicone oil | 0.03 g |
| Surfactant W-1 | 3.0 mg |
| Surfactant W-2 | 0.03 g |

Furthermore, the additives F-1 to F-8 were added to all of the emulsion layers in addition to the compositions indicated above. Moreover, the gelatin hardening agent H-1 and the surfactants W-3, W-4 and W-5 for coating and emulsifying purposes were added to each layer in addition to the compositions indicated above.

Moreover, phenol, 1,2-benzisothiazolin-3-one, 2-phenoxyethanol and phenethyl alcohol were added as biocides and fungicides.

The silver iodobromide emulsions used are indicated below.

| Emulsion Content | | Average Grain (μm) | Variation Size (%) | AgI Coefficient (%) |
|---|---|---|---|---|
| A | Monodisperse tetradecahedral grains | 0.25 | 16 | 3.7 |
| B | Monodisperse cubic internal latent image type grains | 0.30 | 10 | 3.3 |
| C | Monodisperse tetradecahedral grains | 0.30 | 18 | 5.0 |
| D | Polydisperse twinned crystal grains | 0.60 | 25 | 2.0 |
| E | Monodisperse cubic grains | 0.17 | 17 | 4.0 |
| F | Monodisperse cubic grains | 0.20 | 16 | 4.0 |
| G | Monodisperse cubic internal latent image type grains | 0.25 | 11 | 3.5 |
| H | Monodisperse cubic internal latent image type grains | 0.30 | 9 | 3.5 |
| I | Polydisperse tabular grains, average aspect ratio 4.0 | 0.80 | 28 | 1.5 |
| J | Monodisperse tetradecahedral grains | 0.30 | 18 | 4.0 |
| K | Monodisperse tetradecahedral grains | 0.37 | 17 | 4.0 |
| L | Monodisperse cubic internal latent image type grains | 0.46 | 14 | 3.5 |
| M | Monodisperse cubic grains | 0.55 | 13 | 4.0 |
| N | Polydisperse tabular grains, average aspect ratio 7.0 | 1.00 | 33 | 1.3 |

Spectral Sensitization of Emulsions A to N

| Emulsion | Sensitizing Dye Added | Amount Added per Mol Silver Halide | Time At Which Sensitizing Dye Was Added |
|---|---|---|---|
| A | S-1 | 0.025 | Immediately after chemical sensitization |
| | S-2 | 0.25 | Immediately after chemical sensitization |
| B | S-1 | 0.01 | Immediately after the end of grain formation |
| | S-2 | 0.25 | Immediately after the end of grain formation |
| C | S-1 | 0.02 | Immediately after chemical sensitization |
| | S-2 | 0.25 | Immediately after chemical sensitization |
| D | S-1 | 0.01 | Immediately after chemical sensitization |
| | S-2 | 0.10 | Immediately after chemical sensitization |
| | S-7 | 0.01 | Immediately after chemical sensitization |
| E | S-3 | 0.5 | Immediately after chemical sensitization |
| | S-4 | 0.1 | Immediately after chemical sensitization |
| F | S-3 | 0.3 | Immediately after chemical sensitization |
| | S-4 | 0.1 | Immediately after chemical sensitization |
| G | S-3 | 0.25 | Immediately after the end of grain formation |
| | S-4 | 0.08 | Immediately after the end of grain formation |

-continued

Spectral Sensitization of Emulsions A to N

| Emulsion | Sensitizing Dye Added | Amount Added per Mol Silver Halide | Time At Which Sensitizing Dye Was Added |
|---|---|---|---|
| H | S-3 | 0.2 | During grain formation |
| | S-4 | 0.06 | During grain formation |
| I | S-3 | 0.3 | Immediately before start of chemical sensitization |
| | S-4 | 0.07 | Immediately before start of chemical sensitization |
| | S-8 | 0.1 | Immediately before start of chemical sensitization |
| J | S-6 | 0.2 | During grain formation |
| | S-5 | 0.05 | During grain formation |
| K | S-6 | 0.2 | During grain formation |
| | S-5 | 0.05 | During grain formation |
| L | S-6 | 0.22 | Immediately after the end of grain formation |
| | S-5 | 0.06 | Immediately after the end of grain formation |
| M | S-6 | 0.15 | Immediately after chemical sensitization |
| | S-5 | 0.04 | Immediately after chemical sensitization |
| N | S-6 | 0.22 | Immediately after the end of grain formation |
| | S-5 | 0.06 | Immediately after the end of grain formation |

C-1

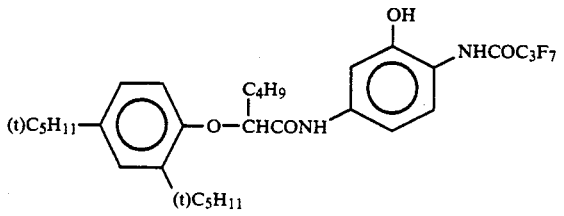

C-2

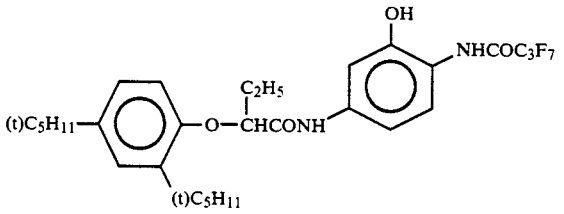

C-3

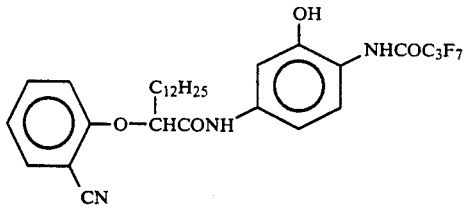

C-4

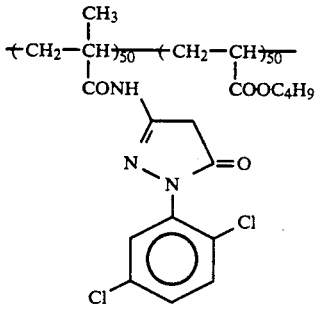

Numbers 50 indicate wt %.

Average Molecular Weight: About 25,000

-continued
C-5
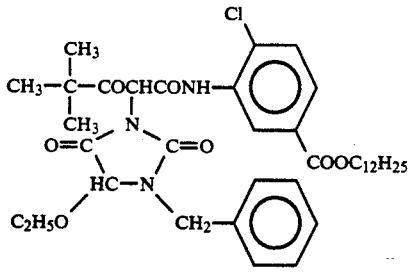
C-6
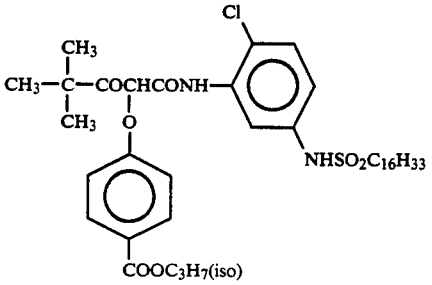
C-7
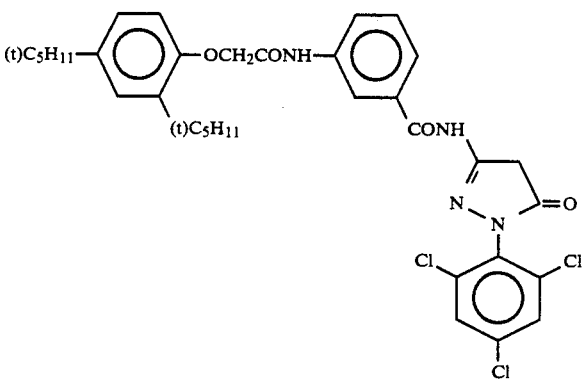
C-9
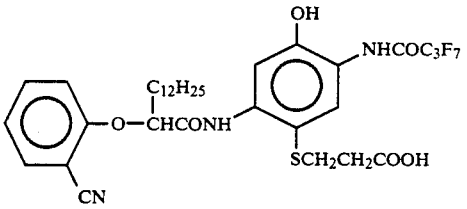
Dibutyl phthalate — Oil-1
Tricresyl phosphate — Oil-2
Oil-3
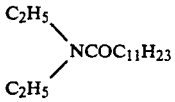
Cpd-A
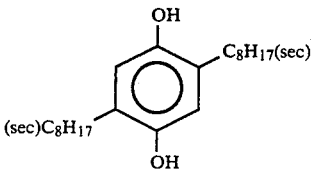

-continued
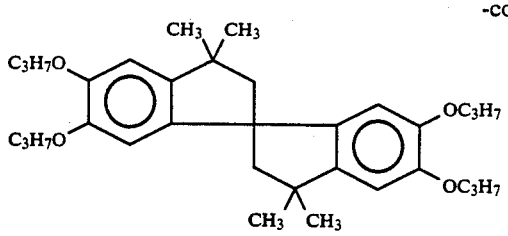
Cpd-B
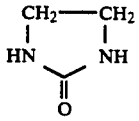
Cpd-C
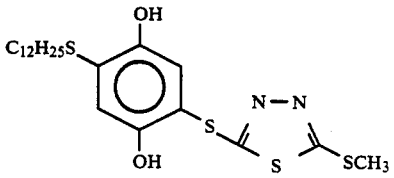
Cpd-D
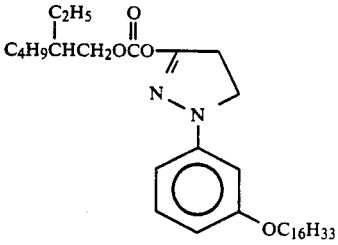
Cpd-E
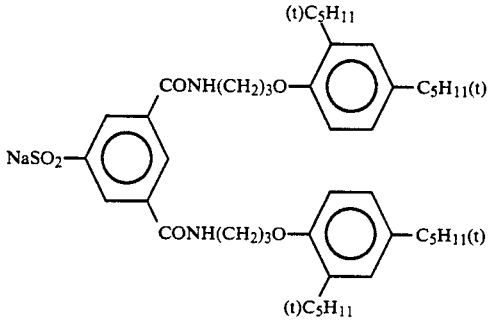
Cpd-F
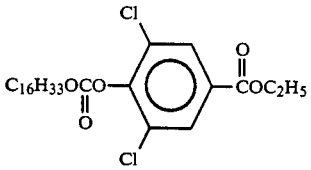
Cpd-G
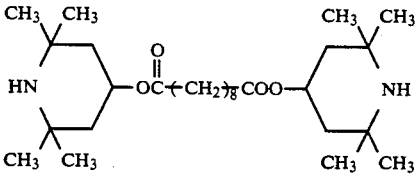
Cpd-H
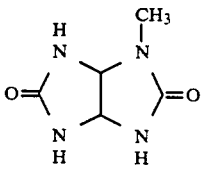
Cpd-I -continued
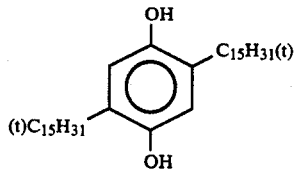
Cpd-J
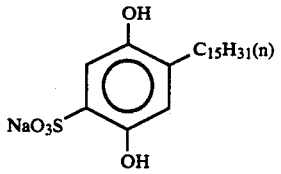
Cpd-K
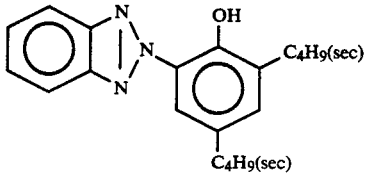
U-1
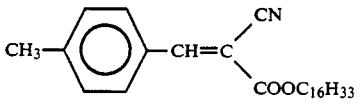
U-2
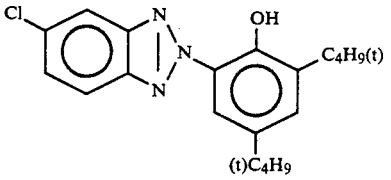
U-3
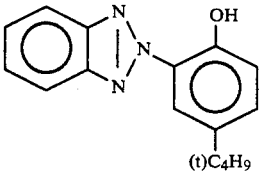
U-4
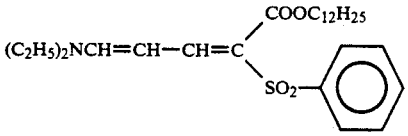
U-5
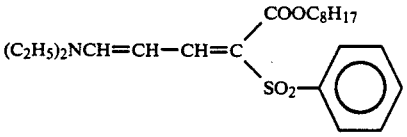
U-6
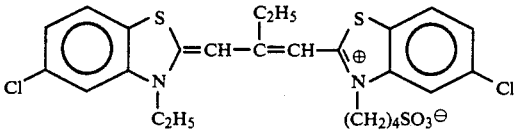
S-1

-continued
S-2
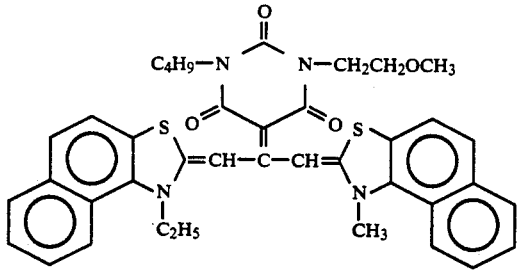
S-3
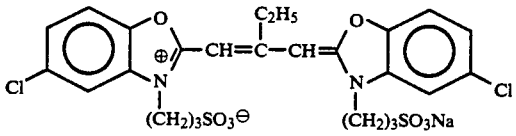
S-4
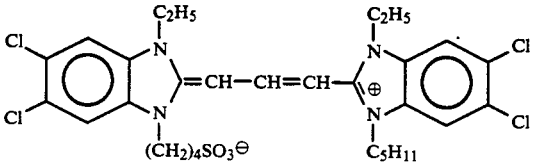
S-5
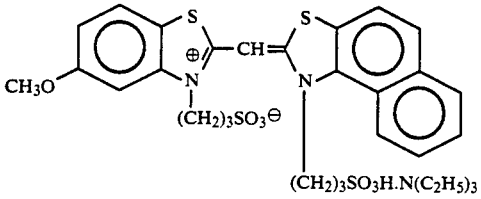
S-6
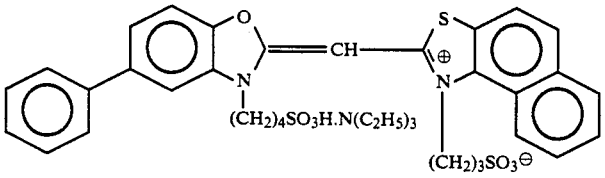
S-7
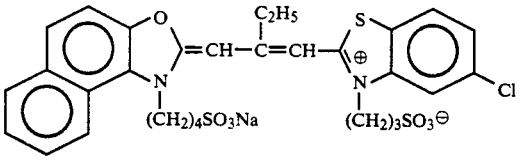
S-8
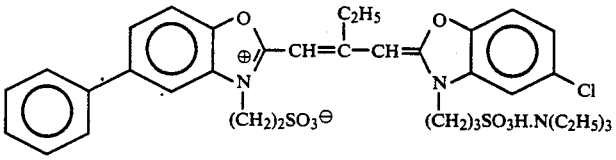
D-1
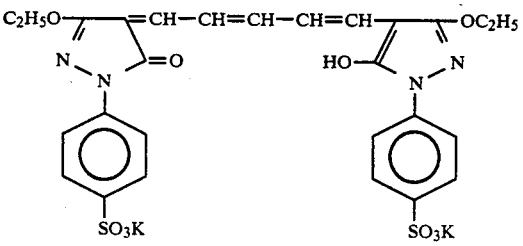

-continued
D-2
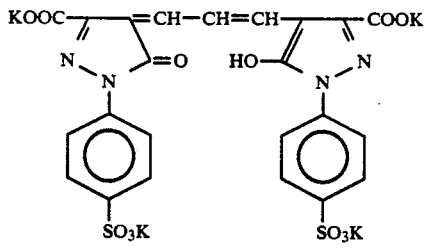
D-3
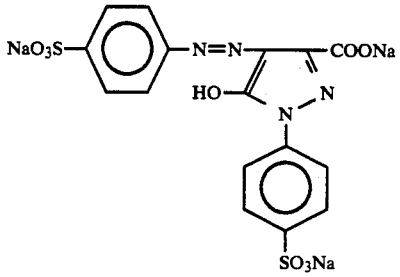
D-4
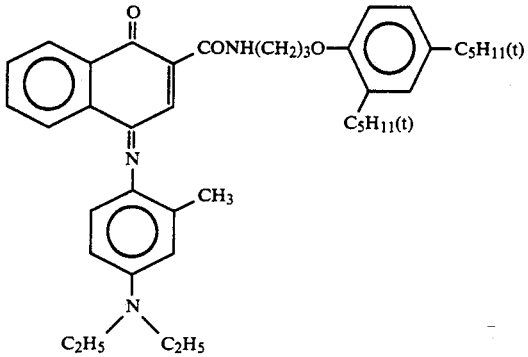
H-1
$CH_2{=}CH{-}SO_2{-}CH_2{-}CONH{-}CH_2$
$CH_2{=}CH{-}SO_2{-}CH_2{-}CONH{-}CH_2$
W-1
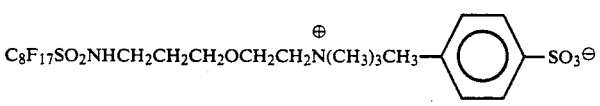
W-2
$C_8F_{17}SO_2N(C_3H_7)CH_2COOK$
W-3
$NaO_3S{-}CH(CH_2COOCH_2CH(C_2H_5)C_4H_9)COOCH_2CH(C_2H_5)C_4H_9$
W-4
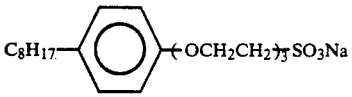
W-5
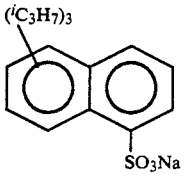
P-1
$\left(CH_2{-}CH(CONHC_4H_9(t))\right)_n$ -continued
M-1
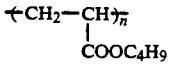
F-1
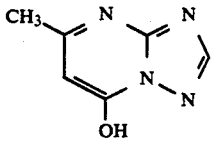
F-2
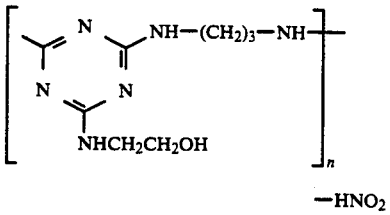
F-3
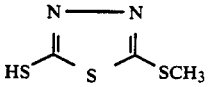
F-4
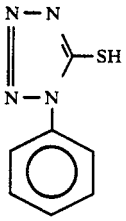
F-5
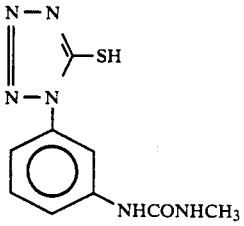
F-6
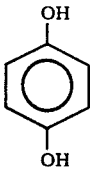
F-7
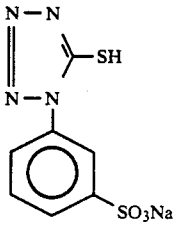
F-8
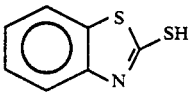

-continued

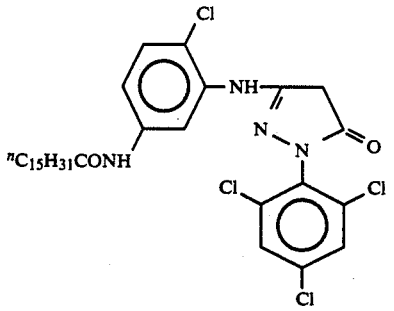

Comparative Coupler A

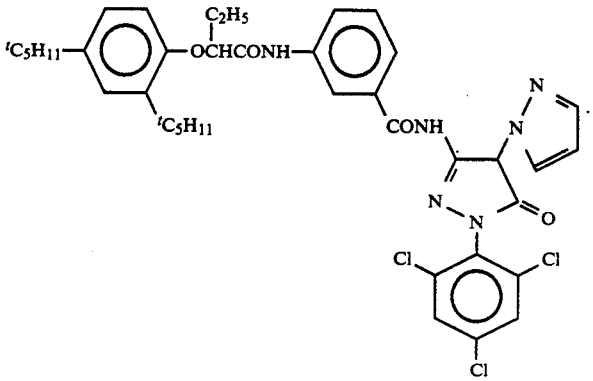

Comparative Coupler B

Preparation of Samples 102 to 128

Samples 102 to 128 were prepared in the same way as Sample 101 except that the Comparative Couplers A and B shown above and the couplers of the present invention as shown in Table 1 were used in equimolar amounts in total in place of the Couplers C-7 and C-4 which were added to layers 9 to 11 in Sample 101.

Samples 101 to 128 which had been obtained in this way were cut into the form of strips and then exposed through an optical wedge. Subsequently, the samples were developed in accordance with the development processing operations indicated below and with processing operations in which the formalin was omitted from the stabilizing bath. The stabilizing baths used in the former operations and the latter ones are designated stabilizing bath (1) and stabilizing bath (2). The characteristic curves were obtained by density measurements and then the image storage properties of the magenta image on storage for 1 week under conditions of 60° C, 70% RH were evaluated. The results obtained were as shown in Table 1.

Next, the RMS graininess which is generally used to evaluate graininess was measured. The measuring aperture was 48 $\mu m\phi$.

Moreover, Samples 101 to 128 were finished into 35 mm size cassettes and photographs were taken. The subject of the photographs was a Macbeth color chart and the red color was set in the middle. The samples obtained were subjected to sensory evaluation by a panel of evaluators.

Moreover, a wedge exposure was made through a green filter and color mixing was evaluated using the cyan density of the $D_{min}$ part in order to evaluate the color mixing between the green-and red-sensitive layers.

The results obtained are summarized in Table 1. It is clear from Table 1 that the Samples embodying the present invention were satisfactory in respect of both graininess and the increase in saturation of the red coloration. Moreover, the storage properties when formalin was omitted were also good. Furthermore, interlayer color mixing was also reduced. This could not have been anticipated from the existing technology.

Here, the statement that the formalin had been omitted is used in the sense that those cases in which formalin was included in amounts which were limited in connection with environmental pollution for example were included within the scope of the present invention while realizing the effect of the invention. Such a formaldehyde content signifies a formaldehyde concentration of not more than about 10 ppm, and especially of not more than bout 1 ppm.

Processing Operations

| Processing Operation | Time (min) | Temp. (°C.) | Tank Capacity (liters) | Replenishment Rate (1/m²) |
|---|---|---|---|---|
| Black-&-White Development | 6 | 38 | 12 | 2.2 |
| First Water Wash | 2 | 38 | 4 | 7.5 |
| Reversal | 2 | 38 | 4 | 1.1 |
| Color Development | 6 | 38 | 12 | 2.2 |
| Conditioning | 2 | 38 | 4 | 1.1 |
| Bleaching | 6 | 38 | 12 | 0.22 |
| Fixing | 4 | 38 | 8 | 1.1 |
| Second Water Wash | 4 | 38 | 8 | 7.5 |
| Stabilization | 1 | 25 | 2 | 1.1 |

The composition of each processing bath was as indicated below.

| Black-and-White Developer | Tank Solution | Replenisher |
|---|---|---|
| Nitrilo-N,N,N-trimethylenephosphonic acid, pentasodium salt | 2.0 g | 2.0 g |
| Potassium sulfite | 30 g | 30 g |
| Hydroquinone monosulfonic acid, potassium salt | 20 g | 20 g |
| Potassium carbonate | 33 g | 33 g |
| 1-Phenyl-4-methyl-4-hydroxymethyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water to make | 1000 ml | 1000 ml |
| pH | 9.60 | 9.60 |
| The pH was adjusted with hydrochloric acid or potassium hydroxide. | | |

| Reversal Bath | Tank Solution | Replenisher |
|---|---|---|
| Nitrilo-N,N,N-trimethylenephosphonic acid, pentasodium salt | 3.0 g | Same as Tank Solution |
| Stannous chloride, dihydrate | 1.0 g | |
| p-Aminophenol | 0.1 g | |
| Sodium hydroxide | 8 g | |
| Glacial acetic acid | 15 ml | |
| Water to make | 1000 ml | |
| pH | 6.00 | |
| The pH was adjusted with hydrochloric acid or sodium hydroxide. | | |

| Color Developer | Tank Solution | Replenisher |
|---|---|---|
| Nitrilo-N,N,N-trimethylenephosphonic acid, pentasodium salt | 2.0 g | 2.0 g |
| Sodium sulfite | 7.0 g | 7.0 g |
| Trisodium phosphate, dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-Ethyl-(β-methanesulfonamidoethyl-3-methyl-4-aminoaniline sulfate | 11 g | 11 g |
| 3,6-Dithia-1,8-octanediol | 1.0 g | 1.0 g |
| Water to make | 1000 ml | 1000 ml |
| pH | 11.80 | 12.00 |
| The pH was adjusted with hydrochloric acid or potassium hydroxide. | | |

| Conditioner | Tank Solution | Replenisher |
|---|---|---|
| Ethylenediaminetetraacetic acid, disodium salt, dihydrate | 8.0 g | Same as Tank Solution |
| Sodium sulfite | 12 g | |
| 1-Thioglycerine | 0.4 ml | |

-continued

| Conditioner | Tank Solution | Replenisher |
|---|---|---|
| Sorbitan ester* | 0.1 g | |
| Water to make | 1000 ml | |
| pH | 6.20 | |
| The pH was adjusted with hydrochloric acid or sodium hydroxide. | | |

| Bleaching Solution | Tank Solution | Replenisher |
|---|---|---|
| Ethylenediaminetetraacetic acid, disodium salt, dihydrate | 2.0 g | 4.0 g |
| Ethylenediaminetetraacetic acid, ferric ammonium salt, dihydrate | 120 g | 240 g |
| Potassium bromide | 100 g | 200 g |
| Ammonium nitrate | 10 g | 20 g |
| Water to make | 1000 ml | 1000 ml |
| pH | 5.70 | 5.50 |
| The pH was adjusted with hydrochloric acid or sodium hydroxide. | | |

| Fixing Solution | Tank Solution | Replenisher |
|---|---|---|
| Ammonium thiosulfate | 8.0 g | Same as Tank Solution |
| Sodium sulfite | 2.0 g | |
| Sodium Bisulfite | 5.0 g | |
| Water | to make up to 1000 ml | |
| pH | 6.60 | |
| The pH was adjusted with hydrochloric acid or aqueous ammonia. | | |

| Stabilizing Bath (1) | Tank Solution | Replenisher |
|---|---|---|
| Formalin (37%) | 5.0 ml | Same as Tank Solution |
| Polyoxyethylene p-mono-nonylphenyl ether (average degree of polymerization 10) | 0.5 ml | |
| Water to make | 1000 ml | |
| pH | Not adjusted | |

Sorbitan Ester*

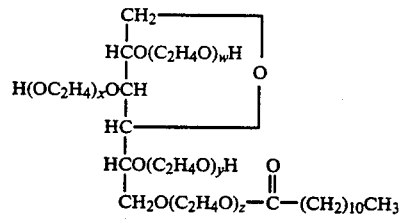

(w + x + y + z = 20)

TABLE 1

| Sample No. | Ninth/Tenth Layer Coupler | Eleventh Layer Coupler | Fading of the Magenta Image: Stabilizing Bath (1) | Fading of the Magenta Image: Stabilizing Bath (2) | RMS Graininess of the Magenta Image | Red Reproduction | Inter-layer Color Mixing |
|---|---|---|---|---|---|---|---|
| 101 (Comparative Example) | C-7/C-4 | C-4 | −0.01 | −0.25 | 0.013 | Control | Control |
| 102 (Comparative Example) | Compara. Coupler A/ Compara. Coupler A | Compara. Coupler A | ±0 | −0.01 | 0.015 | Red Cast | +0.03 |
| 103 (Comparative Example) | Compara. Coupler B/ Compara. Coupler B | Compara. Coupler B | ±0 | ±0 | 0.020 | Same as Control | +0.03 |
| 104 (Comparative | C-7/C-4 | I-4 | ±0 | −0.20 | 0.013 | " | +0.01 |

TABLE 1-continued

| Sample No. | Ninth/Tenth Layer Coupler | Eleventh Layer Coupler | Fading of the Magenta Image: Stabilizing Bath (1) | Fading of the Magenta Image: Stabilizing Bath (2) | RMS Graininess of the Magenta Image | Red Reproduction | Inter-layer Color Mixing |
|---|---|---|---|---|---|---|---|
| Example) | | | | | | | |
| 105 (Comparative Example) | Compara. Coupler A/ Compara. Coupler A | " | −0.01 | −0.01 | 0.014 | " | +0.02 |
| 106 (Comparative Example) | Compara. Coupler B/ Compara. Coupler B | " | +0.01 | −0.01 | 0.023 | " | +0.06 |
| 107 (Comparative Example) | C-7/C-4 | I-18 | +0.01 | −0.23 | 0.013 | " | +0.01 |
| 108 (Comparative Example) | Compara. Coupler A/ Compara. Coupler A | " | −0.01 | −0.02 | 0.014 | " | +0.01 |
| 109 (Comparative Example) | Compara. Coupler B/ Compara. Coupler B | " | ±0 | −0.01 | 0.022 | " | +0.05 |
| 110 (Comparative Example) | C-7/C-4 | M-30 | ±0 | −0.15 | 0.024 | Slightly Crimson | +0.01 |
| 111 (Comparative Example) | Compara. Coupler A/ Compara. Coupler A | " | ±0 | −0.01 | 0.026 | " | +0.07 |
| 112 (Comparative Example) | Compara. Coupler B/ Compara. Coupler B | " | ±0 | ±0 | 0.027 | " | ±0.05 |
| 113 (This Invention) | M-4/M-4 | I-4 | −0.01 | −0.01 | 0.013 | High Saturation | −0.01 |
| 114 (This Invention) | M-11/M-11 | " | ±0 | −0.01 | 0.013 | " | −0.02 |
| 115 (This Invention) | M-12/M-12 | " | +0.01 | ±0 | 0.014 | " | −0.02 |
| 116 (This Invention) | M-21/M-21 | " | +0.01 | ±0 | 0.013 | " | −0.02 |
| 117 (This Invention) | M-30/M-30 | " | ±0 | −0.01 | 0.014 | " | −0.02 |
| 118 (This Invention) | M-4/M-4 | I-18 | ±0 | −0.01 | 0.013 | High Saturation | −0.02 |
| 119 (This Invention) | M-11/M-11 | " | +0.01 | −0.01 | 0.012 | " | −0.02 |
| 120 (This Invention) | M-12/M-12 | " | +0.01 | −0.01 | 0.013 | " | −0.02 |
| 121 (This Invention) | M-21/M-21 | " | +0.01 | −0.01 | 0.013 | " | −0.02 |
| 122 (This Invention) | M-30/M-30 | " | ±0 | −0.01 | 0.013 | " | −0.02 |
| 123 (This Invention) | M-30/M-30 | I-13 | −0.01 | −0.01 | 0.014 | " | −0.02 |
| 124 (This Invention) | M-30/M-30 | I-24 | −0.01 | −0.01 | 0.012 | " | −0.03 |
| 125 (This Invention) | M-30/M-30 | I-36 | −0.01 | −0.01 | 0.013 | " | −0.03 |
| 126 (Comparative Example) | M-30/M-30 | M-30 | −0.01 | ±0 | 0.023 | " | +0.03 |
| 127 (This Invention) | I-18/I-18 | " | −0.01 | ±0 | 0.016 | High Saturation but Slightly Worse than Sample 117 | +0.01 |
| 128 (Comparative Example) | M-30/M-30 | C-4 | −0.01 | −0.20 | 0.014 | Slight Higher Saturation than Control | +0.01 |

EXAMPLE 2

The Samples 101 to 128 prepared in Example 1 were evaluated in terms of inter-layer color mixing in the same way as in Example 1 using a color developer obtained by omitting the citrazinic acid for the color developer used in Example 1, reducing the sodium sulfite content to 2.5 grams and lowering the pH from 11.8 to 10.25.

The results obtained indicated no great difference in the extent of inter-layer color mixing for Samples 101 to 128.

As indicated by the results of Examples 1 and 2, both graininess and color reproduction are satisfactory with combinations of the compounds of formulas (I) and (M) of the present invention, the deterioration of image storage properties when formalin is omitted from the stabilizing bath is prevented and, moreover, inter-layer color mixing is reduced.

While the invention has been described in detail and with reference to specific examples, persons skilled in the art will recognize that changes and variations may be made from the description without departing from the spirit and scope of the invention.

What is claimed is:

1. A silver halide color photographic photosensitive material comprising a support, having thereon at least one silver halide emulsion layer, wherein a coupler represented by formula (I) shown below is included in at least one layer of the photosensitive material, and a coupler represented by formula (M) shown below is included in at least one layer of the photosensitive material:

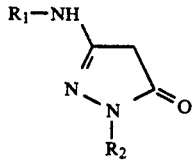

(I)

wherein $R_1$ represents an aryl group having substituents the sum of whose Hammett's rule substituent $\sigma$ constants is at least 0.2, and $R_2$ represents an aryl group having substituents the sum of whose Hammett's rule substituent $\sigma$ constants is at least 0.75;

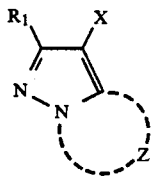

(M)

wherein $R_1$ represents a hydrogen atom or a substituent group; Z represents a group of nonmetal atoms which is required to form either (1) a five-membered azole ring which has two or three nitrogen atoms, and which may have substituent groups (including condensed rings), or (2) an unsubstituted five-membered azole ring which has four nitrogen atoms; and X represents a hydrogen atom or a group which can be eliminated at the time of a coupling reaction with an oxidation product of a developing agent.

2. The silver halide color photographic photosensitive material of claim 1, comprising a green sensitive emulsion layer unit consisting of at least two layers which have different photographic speeds, wherein at least one coupler represented by formula (I) is included in the higher speed layer and at least one coupler represented by formula (M) is included in the lower speed layer.

3. The silver halide color photographic photosensitive material of claim 1, wherein $R_1$ in formula (I) is represented by formula (II) shown below:

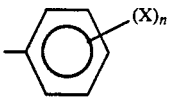

(II)

wherein X represents a substituent group; n represents an integer of from 1 to 5; and the sum of the Hammett's rule substituent o constants of $-(X)_n$ is at least 0.2.

4. The silver halide color photographic photosensitive material of claim 1, wherein $R_2$ in formula (I) is represented by formula (IV) shown below:

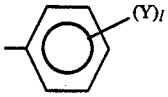

(IV)

wherein Y represents a substituent group; l represents an integer of from 1 to 5; and the sum of the Hammett's rule substituent $\sigma$ constants of —(Y)l in formula (IV) is at least 0.75.

5. The silver halide color photographic photosensitive material of claim 1, wherein $R_2$ in formula (I) is represented by formula (V) shown below:

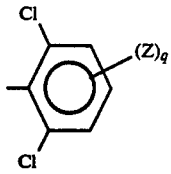

(V)

wherein Z represents a substituent group; q represents an integer of from 1 to 3; and the sum of the Hammett's rule substituent $\sigma$ constants of the substituent groups on the benzene ring in formula (V) is at lease 0.75.

6. The silver halide color photographic photosensitive material of claim 1, wherein the coupler represented by formula (M) is selected from the group consisting of 1H-imidazo [1,2-b]pyrazole, 1H-pyrazolo[1,5-b][1,2,4]-triazole, 1H-pyrazolo[5,1-c][1,2,4]-triazole and 1H-pyrazolo[1,5-d)tetrazole couplers.

7. The silver halide color photographic photosensitive material of claim 1, wherein the coupler represented by formula (M) is selected from the group consisting of couplers represented by formulae (M-I), (M-II), (M-III) and (M-IV):

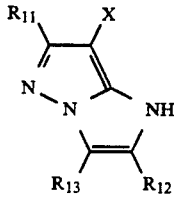

(M-I)

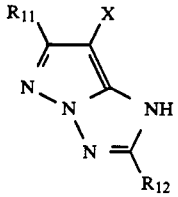

(M-II)

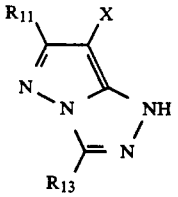

(M-III)

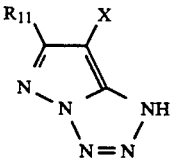

(M-IV)

wherein $R_{11}$, $R_{12}$ and $R_{13}$ each represents a hydrogen atom, a halogen atom, an alkyl group, an aryl group, a heterocyclic group, a cyano group, a hydroxy group, a nitro group, a carboxy group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a cyclohexylthio group, a sulfinyl group, a phosphonyl group, an aryloxycarbonyl group, an acyl group or an azolyl group; provided that dimers may be formed with $R_{11}$ as a divalent group; and X represents a hydrogen atom or a group which can be split off in a reaction with an oxidation product of a primary aromatic amine color developing agent.

* * * * *